US010006111B2

(12) United States Patent
Fukae et al.

(10) Patent No.: US 10,006,111 B2
(45) Date of Patent: Jun. 26, 2018

(54) SINTERED ALLOY AND MANUFACTURING METHOD THEREOF

(71) Applicant: HITACHI POWDERED METALS CO., LTD., Matsudo-shi, Chiba (JP)

(72) Inventors: Daisuke Fukae, Matsudo (JP); Hideaki Kawata, Matsudo (JP)

(73) Assignee: HITACHI POWDERED METALS CO., LTD., Chiba (JP)

( * ) Notice: Subject to any disclaimer, the term of this patent is extended or adjusted under 35 U.S.C. 154(b) by 0 days. days.

(21) Appl. No.: 15/366,609

(22) Filed: Dec. 1, 2016

(65) Prior Publication Data

US 2017/0081747 A1 Mar. 23, 2017

Related U.S. Application Data

(62) Division of application No. 13/584,151, filed on Aug. 13, 2012, now abandoned.

(30) Foreign Application Priority Data

Sep. 7, 2011 (JP) ..... 2011-195087

(51) Int. Cl.
*B22F 3/16* (2006.01)
*C22C 38/40* (2006.01)
(Continued)

(52) U.S. Cl.
CPC ..... *C22C 38/40* (2013.01); *B22F 1/0011* (2013.01); *B22F 3/16* (2013.01); *C22C 1/03* (2013.01);
(Continued)

(58) Field of Classification Search
CPC ..... B22F 1/00; B22F 1/0003; B22F 1/0011; B22F 3/12; B22F 3/16; C22C 33/02;
(Continued)

(56) References Cited

U.S. PATENT DOCUMENTS

| | | | |
|---|---|---|---|
| 6,852,143 | B2 | 2/2005 | Hayashi et al. |
| 2009/0269235 | A1 | 10/2009 | Fukae et al. |
| 2011/0132499 | A1 | 6/2011 | Yamanaka et al. |

FOREIGN PATENT DOCUMENTS

| | | | |
|---|---|---|---|
| EP | 2003221 | A1 | 12/2008 |
| JP | 3784003 | B2 | 6/2006 |
| JP | 2010215951 | A | 9/2010 |

OTHER PUBLICATIONS

Mar. 8, 2017 Office Action issued in German Patent Application No. 102012016645.1.

(Continued)

*Primary Examiner* — Colleen Dunn
*Assistant Examiner* — Anthony Liang
(74) *Attorney, Agent, or Firm* — Oliff PLC

(57) ABSTRACT

A sintered alloy includes, in percentage by mass, Cr: 11.75 to 39.98, Ni: 5.58 to 24.98, Si: 0.16 to 2.54, P: 0.1 to 1.5, C: 0.58 to 3.62 and the balance of Fe plus unavoidable impurities; a phase A containing precipitated metallic carbides with an average particle diameter of 10 to 50 μm; and a phase B containing precipitated metallic carbides with an average particle diameter of 10 μm or less, wherein the phase A is randomly dispersed in the phase B and the average particle diameter DA of the precipitated metallic carbides in the phase A is larger than the average particle diameter DB of the precipitated metallic carbides of the phase B.

8 Claims, 2 Drawing Sheets

(51) Int. Cl.

| | |
|---|---|
| ***C22C 33/02*** | (2006.01) |
| ***C22C 1/03*** | (2006.01) |
| ***C22C 38/00*** | (2006.01) |
| ***C22C 38/02*** | (2006.01) |
| ***C22C 38/34*** | (2006.01) |
| ***C22C 38/58*** | (2006.01) |
| ***B22F 1/00*** | (2006.01) |

(52) U.S. Cl.
CPC ..... *C22C 33/0207* (2013.01); *C22C 33/0285* (2013.01); *C22C 38/002* (2013.01); *C22C 38/02* (2013.01); *C22C 38/34* (2013.01); *C22C 38/58* (2013.01)

(58) Field of Classification Search
CPC ..... C22C 33/0207; C22C 33/0214; C22C 33/0257; C22C 33/0285; C22C 38/02; C22C 38/08; C22C 38/12; C22C 38/18; C22C 38/22; C22C 38/24; C22C 38/26; C22C 38/34; C22C 38/36; C22C 38/40; C22C 38/44; C22C 38/46; C22C 38/48; C22C 38/56
See application file for complete search history.

(56) References Cited

OTHER PUBLICATIONS

May 18, 2016 Office Action Issued in U.S Appl. No. 13/584,151.
Sep. 1, 2016 Office Action Issued in U.S Appl. No. 13/584,151.

SINTERED ALLOY AND MANUFACTURING METHOD THEREOF

CROSS-REFERENCE TO RELATED APPLICATION

This is a Divisional of application Ser. No. 13/584,151 filed Aug. 13, 2012, which claims the benefit of priority from the prior Japanese Patent Application No. 2011-195087 filed on Sep. 7, 2011; the entire contents which are incorporated herein by reference.

BACKGROUND

1. Field of the Invention

The present invention relates to a sintered alloy which is suitable for a turbo component for turbocharger, particularly a nozzle body and the like which require heat resistance, corrosion-resistance and wear-resistance, and a method for manufacturing the sintered alloy.

2. Background of the Invention

Generally, in a turbocharger provided in an internal combustion engine, a turbine is rotatably supported by a turbine housing connected with an exhaust manifold of the internal combustion engine and a plurality of nozzle vanes are rotatably supported so as to surround the periphery of the turbine. An exhaust gas flowed in the turbine housing is flowed in the turbine from the outside thereof and emitted in the axial direction thereof while the turbine is rotated. Then, air to be supplied into the internal combustion engine is compressed by the rotation of an air compressor which is provided at the same shaft in the opposite side of the turbine.

Here, the nozzle vanes are rotatably supported by a ring-shaped component called as a "nozzle body" or "mount nozzle". The shaft of the nozzle vanes is passed through the nozzle body and connected with a link mechanism. Then, the nozzle vanes are rotated by driving the link mechanism so that the degree of opening of the inflow path of the exhaust gas is controlled. The present invention is directed at a turbo component such as the nozzle body (mount nozzle) or plate nozzle to be attached thereto which is to be provided in the turbine housing.

The aforementioned turbo component for turbocharger requires heat resistance and corrosion resistance because the turbo component is contacted with high temperature corrosion gas and requires wear resistance because the turbo component is slid relative to the nozzle vanes. In this point of view, conventionally, high chrome cast steel, wear-resistant material made of JIS (Japanese Industrial Standards) SCH22 to which chrome surface treatment is conducted for the enhancement of corrosion resistance and the like are used. Moreover, as an inexpensive wear-resistant component having heat resistance, corrosion resistance and wear resistance is proposed a wear-resistant sintered component in which carbides are dispersed in the base material of a ferric steel material (Refer to Patent document No. 1).

However, since the sintered component disclosed in Patent document No. 1 is formed through liquid phase-sintering, the sintered component may be machined as the case of severe dimensional accuracy. Since the large amount of hard carbides are precipitated in the sintered component, the machinability of the sintered component is not good and thus required to be improved. Moreover, the turbo component is normally made of austenitic heat-resistant material, but the turbo component disclosed in Patent document No. 1 is made of ferritic stainless material. In this case, since the thermal expansion coefficient of the turbo component is different from those of the adjacent components, some spaces are formed between the turbo component and the adjacent components, causing the insufficient connections between the turbo component and the adjacent components and rendering component design available in the turbocharger difficult. It is therefore desired that the turbo component has a similar thermal expansion coefficient to those of the adjacent components made of austenitic heat-resistant material.

Patent document No. 1: JP-B2 No. 3784003 (Patent)

BRIEF SUMMARY OF THE INVENTION

It is an object of the present invention to provide a sintered alloy which has excellent heat resistance, corrosion resistance, wear resistance and machinability, and has a similar thermal expansion coefficient to that of austenitic heat-resistant material, thereby rendering component design easy. It is also an object of the present invention to provide a method for manufacturing the sintered alloy.

In order to solve out the aforementioned problem, the first gist of a sintered alloy according to the present invention is that the sintered alloy is consisted of two kinds of phases: one is a phase A containing larger dispersed carbides therein and having heat resistance and corrosion resistance, and the other is a phase B containing smaller dispersed carbides therein and having heat resistance and corrosion resistance, and that the sintered alloy has such a metallic structure as the phase A is dispersed in the phase B randomly. The phase B containing smaller dispersed carbides enhances the conformability of the carbides dispersed therein, allowing the enhancement of the wear resistance thereof and reducing the attack on the opponent component so as to prevent the abrasion of the opponent component, as compared with a sintered alloy containing larger carbides dispersed uniformly. Moreover, since the sizes of the carbides are small, the attack of the carbides on the edge of a cutting tool is reduced so as to contribute to the enhancement of machinability. However, if the sintered alloy includes only the phase B, plastic flow may be likely to be generated in the sintered alloy. In the present invention, therefore, the plastic flow of the phase B is prevented by randomly dispersing the phase A containing larger dispersed carbides therein into the phase B, thereby contributing to the wear resistance of the sintered alloy. Since the sintered alloy of the present invention is configured as described above, the sintered alloy can strike the balance between the enhancement of wear resistance and the enhancement of machinability.

The second gist of the sintered alloy of the present invention is that nickel is contained in the phase A and the phase B so that both of the phase A and the phase B have respective austenitic structures. In this manner, if the base material of the sintered alloy is entirely rendered austenitic structure, the heat resistance and corrosion resistance of the sintered alloy can be enhanced at high temperature while the sintered alloy can have a similar thermal expansion coefficient to those of the adjacent austenitic heat-resistance materials.

The first gist of the manufacturing method of the sintered alloy according to the present invention is that iron alloy powder A containing precipitated carbides by the preliminary addition of carbon and iron alloy powder B not containing precipitated carbides not by the preliminary addition of carbon are used in order to obtain the sintered alloy having the phase A containing dispersed larger carbides and the phase B containing dispersed smaller carbides and having the metallic structure in which the phase A is randomly dispersed in the phase B.

The second gist of the manufacturing method of the present invention is that nickel is contained in the iron alloy powder A and the iron alloy powder B and nickel powder are added to the iron alloy powder A and the iron alloy powder B so as to render the phase A and phase B austenitic structure.

Concretely, the sintered alloy of the present invention is characterized by essentially consisting of, in percentage by mass, Cr: 11.75 to 39.98, Ni: 5.58 to 24.98, Si: 0.16 to 2.54, P: 0.1 to 1.5, C: 0.58 to 3.62 and the balance of Fe plus unavoidable impurities and characterized in that the phase A containing precipitated metallic carbides with an average particle diameter of 10 to 50 μm is randomly dispersed in the phase B containing precipitated metallic carbides with an average particle diameter of 10 μm or less and the average particle diameter DA of the precipitated metallic carbides of the phase A is larger than the average particle diameter DB of the precipitated metallic carbides of the phase B (i.e. DA>DB)

In an aspect of the sintered alloy of the present invention, the maximum diameter of the phase A is 500 μm or less and the occupied area of the phase A is within a range of 20 to 80% relative to all of the base material of the sintered alloy, and the sintered alloy further consists of 5% or less of at least one selected from the group consisting of Mo, V, W, Nb and Ti.

A method for manufacturing a sintered alloy according to the present invention is characterized by comprising the steps of preparing iron alloy powder A consisting of, in percentage by mass, Cr: 25 to 45, Ni: 5 to 15, Si: 1.0 to 3.0, C: 0.5 to 4.0 and the balance of Fe plus unavoidable impurities, preparing iron alloy powder B consisting of, in percentage by mass, Cr: 12 to 25, Ni: 5 to 15 and the balance of Fe plus unavoidable impurities, preparing iron-phosphorus powder consisting of, in percentage by mass, P:10 to 30 and the balance of Fe plus unavoidable impurities, nickel powder and graphite powder, blending raw material powder by mixing the iron alloy powder A with the iron alloy powder B so that a ratio of the iron alloy powder A to the total of the iron alloy powder A and the iron alloy powder B is within a range of 20 to 80 mass %, and adding the iron-phosphorus powder within a range of 1.0 to 5.0 mass %, the nickel powder within a range of 1 to 12 mass % and the graphite powder within a range of 0.5 to 2.5 mass %; pressing the raw material podwer to obtain a compact; and sintering the compact.

In a preferred embodiment of the manufacturing method of the present invention, the maximum particle diameter of the iron alloy powder A and the iron alloy powder B is within a range of 300 μm or less (which corresponds to the diameter of powder passing a sieve with 50 mesh) respectively, and the maximum particle diameter of the nickel powder is within a range of 43 μm or less (which corresponds to the diameter of powder passing a sieve with 325 mesh). In another preferred embodiment, at least one of the iron alloy powder A and the iron alloy powder B consists of 1 to 5 mass % of at least one selected from the group consisting of Mo, V, W, Nb, and Ti relative to the aforementioned iron alloy powder A and iron alloy powder B, and the preferred sintering temperature is within a range of 1000 to 1200° C.

The sintered alloy of the present invention is suitable for a turbo component for turbocharger, and has the phase A containing precipitated metallic carbides with an average particle diameter of 10 to 50 μm and the phase B containing precipitated metallic carbides with an average particle diameter of 10 μm or less so as to exhibit the metallic structure such that the phase A is randomly dispersed in the phase B, thereby having excellent heat resistance, corrosion resistance and wear resistance at high temperature and machinability. Moreover, since the sintered alloy of the present invention has the austenitic base material, the sintered alloy has a similar thermal expansion coefficient to that of austenitic heat-resistant material, thereby simplifying component design.

Figure 1:
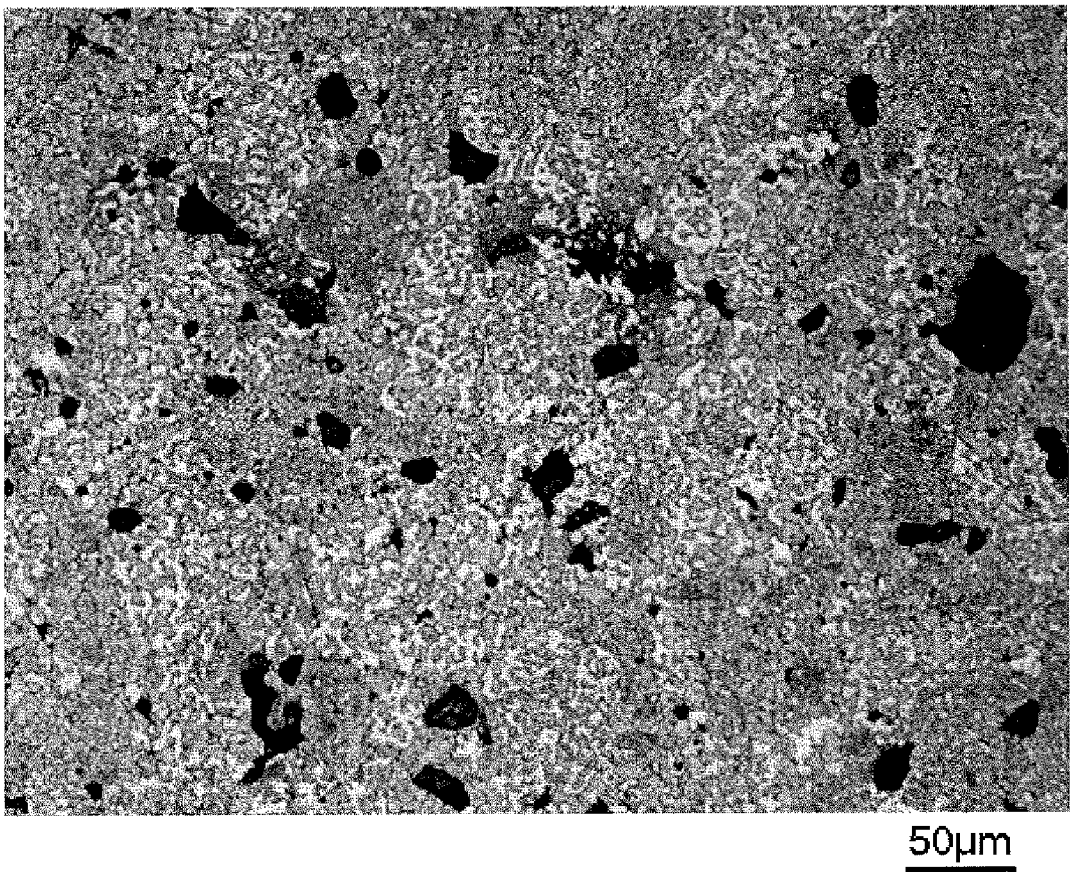
FIG. 1 is an example of metallic structure photograph of a sintered alloy according to the present invention.

MODE FOR CARRYING OUT THE INVENTION (Metallic Structure of Sintered Alloy)

The sizes of carbides affect the wear resistance of a sintered alloy containing the carbides. The wear resistance of the sintered alloy can be enhanced if the sintered alloy contains the carbides as much as possible. However, if the sintered alloy contains too much carbides, the attack on opponent components of the sintered alloy is increased while the wear resistance of the sintered alloy itself can be enhanced, which results in a large amount of wear for the total of the sintered alloy and the opponent components. In the case that only larger carbides are dispersed in the base material of the sintered alloy, if the distribution degree of the larger carbides is increased to some degrees so as to enhance the wear resistance of the sintered alloy, a larger amount of carbon is required so that the distribution degree of hard carbides is increased, resulting in the deterioration of machinabiity of the sintered alloy.

In the sintered alloy of the present invention, the sintered alloy is consisting of two phases: one is a phase A containing larger dispersed carbides and the other is a phase B containing smaller dispersed carbides. Therefore, if the distribution degree of carbide is increased, the wear resistance of the sintered alloy can be enhanced because the amount of carbon can be entirely reduced in the sintered alloy, which allows the attack on the opponent components of the sintered body to be reduced and enhances the machinability of the sintered body.

The larger carbide phases prevent the adhesive wear of the base material of the sintered alloy and the plastic flow of the sintered alloy. Therefore, the carbides with respective diameters of 10 μm or less cannot contribute to the prevention of the plastic flow of the sintered alloy. On the other hand, if the carbides have the respective diameters of 50 μm or more, the carbides themselves are aggregated so as to locally attack the opponent components. If the carbides grow too large, the spaces between the adjacent carbides are enlarged so that the areas of the base material not containing the carbides, which are likely to be the origin of the adhesive wear of the sintered alloy, are also enlarged. In this point of view, the sizes of the carbides contained in the phase A are set within a range of 10 to 50 μm as an average particle diameter.

The areas where no carbide is precipitated except the areas containing the phase A having the larger dispersed carbides therein promote the adhesive wear on the opponent component. Therefore, carbides is needed to be dispersed in the areas except the areas containing the phase A having the larger carbides so as to prevent the adhesive wear. In this point of view, the areas except the areas containing the phase A having the larger carbides are rendered the phase B containing smaller dispersed carbides. In this manner, by setting the sizes of the carbides contained in the phase B smaller than the sizes of the carbides contained in the phase A, the total amount of carbon can be reduced so that the total amount of carbides can be also reduced while the carbide distribution is kept at high degree. The sizes of the smaller carbides dispersed in the phase B are set small enough to prevent the adhesive wear of the sintered alloy, and concretely within a range of 10 μm or less and preferably within a range of 2 μm or more. If the sizes of the carbides dispersed in the phase B are set more than 10 μm, the carbides grow too large to deteriorate the distribution degree of the carbides and thus deteriorate the wear resistance of the sintered alloy. Moreover, if the sizes of the carbides dispersed in the phase B is set less than 2 μm, the adhesive wear of the sintered alloy may not be sufficiently suppressed.

Furthermore, it is required that the average particle diameter DA of the metallic carbides precipitated in the phase A is larger than the average particle diameter DB of the metallic carbides precipitated in the phase B (i.e. , DA>DB). Namely, if the average particle diameter DA of the metallic carbides precipitated in the phase A is set equal to the average particle diameter DB of the metallic carbides precipitated in the phase B, the phase B containing the smaller dispersed carbides cannot be formed independently from the phase A containing the larger dispersed carbides so that any one of the enhancement of wear resistance, the reduction of the attack on the opponent components and the enhancement of machinability of the sintered alloy cannot be realized.

By randomly dispersing the phase A containing the larger dispersed carbides in the phase B containing the smaller dispersed carbides, the wear resistance of the sintered alloy can be maintained while the distribution degree of carbides can be maintained at high degree and the total amount of carbon can be reduced, thereby allowing the attack on the opponent component to be decreased and the machinability to be enhanced.

The ratio of the phase A containing the larger dispersed carbides to the phase B containing the smaller dispersed carbides is set within a range of 20 to 80% with respect to the cross sectional area of the sintered alloy, that is, the base material of the sintered alloy. If the ratio is set less than 20%, the amount of the phase A maintaining the wear resistance is in short supply, resulting in the deterioration of the wear resistance. On the other hand, if the ratio is set more than 80%, the rate of phase contributing to the attack on the opponent components is excessively increased, resulting in the promotion of the attack on the opponent components and in the deterioration of the machinability due to the increase of the larger carbides. The ratio of the phase A to the phase B is preferably set within a range of 30 to 70% and more preferably within a range of 40 to 60%.

Each of the phase A containing the larger dispersed carbides is a phase where larger carbides with respective sizes of 5 to 50 μm are concentratedly dispersed, and the dimension of the phase A is defined by the area linking the peripheries of the larger carbides. If the dimension of the phase A containing the larger dispersed carbides is set more than 500 μm, the larger carbides are likely to be locally dispersed in the phase A, resulting in the local deterioration of the wear resistance of the sintered alloy. Moreover, if cutting process is required, the lifetime of cutting tool is shortened because the hardness in the sintered alloy is locally and remarkably changed. In contrast, if the dimension of the phase A is set less than 10 μm, the sizes of the carbides precipitated and dispersed in the phase A are set less than 5 μm.

(Method for Manufacturing Sintered Alloy and Reason Defining Compositions of Raw Material Powder)

In order to form the metallic structure where the phase A containing the larger dispersed carbides is randomly dispersed in the phase B, an iron alloy powder A to form the phase A and an iron alloy powder B to form the phase B are mixed with one another, pressed and sintered.

The heat resistance and corrosion resistance are required for both of the phase A containing the larger dispersed carbides and the phase B containing the smaller dispersed carbides. Therefore, chromium serving as enhancing the heat resistance and the corrosion resistance of the iron base material through solid solution is contained in the phase A and the phase B. Moreover, chromium is bonded with carbon to form chromium carbide or a composite material made of chromium and iron is formed (hereinafter, both of the chromium carbide and the composite material are abbreviated as "chromium carbide"), thereby enhancing the wear resistance of the sintered alloy. In order that such a chromium effect as described above affects the base material of the sintered alloy uniformly, the chromium is solid-solved in the iron alloy powder A and the iron alloy powder B, respectively.

The iron alloy powder A is prepared as the powder preliminarily containing the chromium carbides by adding a larger amount of chromium than that of the iron alloy powder B therein because the iron alloy powder A inherently contains carbon. In this manner, if the iron alloy powder A containing the chromium carbides therein is used, carbides grow by using the chromium carbides as nuclei, which are preliminarily formed in the iron alloy powder A, during sintering, thereby forming the phase A containing the larger dispersed carbides. In order to obtain such an effect as described above, the iron alloy powder A contains, in percentage by mass, Cr: 25 to 45 and C: 0.5 to 4.0.

Since the chromium carbides are preliminarily precipitated and dispersed in the iron alloy powder A, if the content of the chromium is less than 25 mass %, the chromium is in a short supply in the base material of the sintered alloy, resulting in the deterioration of the heat resistance and the corrosion resistance of the phase A made of the iron alloy powder A. On the other hand, if the content of the chromium of the iron alloy powder A is more than 45 mass %, the compressibility of the iron alloy powder A is remarkably deteriorated. Therefore, the upper limited value of the content of the chromium in the iron alloy powder A is set to 45 mass %.

If the content of the carbon in the iron alloy powder A is less than 0.5 mass %, the chromium carbides are in a short supply so that the carbides serving as the nuclei during the sintering are also in a short supply, thereby having a difficulty in setting the sizes of the carbides to be dispersed in the phase A within the aforementioned range. On the other hand, if the carbon of 4.0 mass % or more is contained in the iron alloy powder A, the amount of the carbides to be precipitated in the iron alloy powder A becomes too much, resulting in the increase of hardness in the iron alloy powder A and in the deterioration of the compressibility of the iron alloy powder A.

On the other hand, since the iron alloy powder B contain chromium in an amount smaller than that of the iron alloy powder A and do not contain carbon, the chromium in the iron alloy powder B is bonded with the carbon in the graphite powder as will be described hereinafter to form the chromium carbides during sintering. However, since the iron alloy powder B do not preliminarily contain the carbon, the growth rates of the chromium carbides in the iron alloy powder B are very slow so as to form the phase B containing the smaller dispersed carbides. Therefore, the iron alloy powder B contains, in percentage by mass, Cr: 12 to 25 and no carbon. Here, the term "no carbon" means that carbon is positively added in the iron alloy powder B and allows unavoidable impurity carbon.

The content of the chromium of the iron alloy powder B is set within a range of 12 to 25 mass %. If the chromium content is set less than 12 mass %, the wear resistance and the corrosion resistance of the phase B are deteriorated due to the shortage of the content of the chromium in the phase B when some chromium carbides are formed during sintering. On the other hand, the content of the chromium to be contained in the iron alloy powder B is required to be restricted in order to minutely disperse the carbides contributing to the wear resistance of the sintered alloy. Therefore, the upper limited value of the content of the chromium in the iron alloy powder B is set to 25 mass %.

The carbon for precipitating and dispersing the carbides in the phase A made of the iron alloy powder A and the phase B made of the iron alloy powder B is added in the form of the graphite powder to the mixture of the iron alloy powder A and the iron alloy powder B. Since the graphite powder is partially consumed by the reduction for the oxide films of the iron alloy powder during sintering, the amount of the graphite powder to be added is required to be defined in view of the consumption of some of the graphite powder for the reduction. Namely, since the iron alloy powder A and the iron alloy powder B contain the chromium which is easily subject to oxidation, chromium oxide films are formed on the respective surfaces of the iron alloy powder A and the iron alloy powder B. Therefore, excess graphite powder is required so as to reduce the chromium oxide films formed on the respective surfaces of the iron alloy powder A and the iron alloy powder B during the sintering. The consumption ratio of the graphite powder for the reduction during the sintering is about 0.2%, the amount of the graphite powder to be added to the iron alloy powder A and the iron alloy powder B may be set to 0.5 mass % or more in prospect of the aforementioned consumption ratio. Namely, the content of the carbon supplied from the graphite powder and solid-solved in the base material of the sintered alloy is about 0.3 mass % or more. On the other hand, the excess addition of the graphite powder causes the excess precipitation of the carbides, resulting in the embrittlement of the sintered alloy, the abrasion of opponent components due to the remarkable increase of the attack on the opponent components wear or the deterioration of the machinability of the sintered alloy. Moreover, excess precipitation of carbides deteriorates the heat resistance and the corrosion resistance of the sintered alloy due to the decrease in content of the chromium contained in the base material of the sintered alloy. Therefore, the upper limited value of the graphite powder is set to 2.5 mass %.

The graphite powder generate Fe—P—C liquid phase with iron-phosphorus alloy powder as will be described hereinafter during sintering so as to decrease the liquefying temperature and thus promote the densification of the sintered alloy.

The base material of the sintered alloy requires the heat resistance and corrosion resistance while the base material thereof has a similar thermal expansion coefficient to those of the adjacent austenitic heat-resistant materials. In the sintered alloy of the present invention, therefore, nickel is solid-solved and thus contained in the base material in order to enhance the heat resistance and the corrosion resistance of the base material of the sintered alloy and render the metallic structure of the base material of the sintered alloy the corresponding austenitic structure. The sintered alloy of the present invention has a metallic structure such that the phase A containing the larger dispersed carbides is randomly dispersed in the phase B containing the smaller dispersed carbides, and in order to render the phase A and the phase B the corresponding austenitic structures, nickel is contained in the iron alloy powder A forming the phase A and the iron alloy powder B forming the phase B while the nickel powder is contained in the iron alloy powder A and the iron alloy powder B.

If the nickel is contained in the iron alloy powder A and B, the base material of the iron alloy powder has a corresponding austenitic structure, thereby reducing the hardness of the iron alloy powder A and B and enhancing the compressibility of the iron alloy powders A and B. If the content of the nickel in the iron alloy powders A and B is less than 5 mass %, the austenitizing of the iron alloy powders A and B becomes insufficient. On the other hand, if the content of the nickel in the iron alloy powders A and B is more than 15 mass %, the compressibility of the iron alloy powders A and B cannot be enhanced. Moreover, the nickel is expensive as compared with iron and chromium and the price of the nickel bare metal soar recently. In this point of view, the content of the nickel in the iron alloy powder A and the iron alloy powder B is set within a range of 5 to 15 mass %.

If the nickel powder is added to the iron alloy powder A and the iron alloy powder B in addition to the solid-solved nickel in the iron alloy powder A and the iron alloy powder B, the densification of the sintered alloy can be promoted. The promotion effect of the densification may become poor if the additive amount of the nickel powder is less than 1 mass %. On the other hand, if the additive amount of the nickel powder is more than 12 mass %, the amount of the nickel powder becomes excess so that the nickel elements of the nickel powder cannot be perfectly diffused into the iron base material of the sintered alloy and thus may remain as they are. Since no carbide is precipitated in the nickel phase formed by the remaining nickel elements in the iron base material of the sintered alloy, the sintered alloy becomes likely to be adhesive to opponent components so that the abrasion is promoted from the adhesive portions of the sintered alloy and the opponent components, thereby deteriorating the wear resistance of the sintered alloy. In this point of view, the additive amount of the nickel powder to the iron alloy powder A and the iron alloy powder B is set within a range of 1 to 12 mass %.

It is preferred that the nickel phase is unlikely to remain in the iron base material as the particle diameters of the nickel powder became small. Moreover, the specific surface area of the nickel powder is increased so that the nickel particles are promoted in diffusion during sintering and the densification of the sintered alloy is enhanced as the particle diameters of the nickel powder become small. In this point of view, the maximum particle diameter of the nickel powder is preferably set to 74 μm or less (corresponding the diameters of powder which can pass a sieve with 200 mesh) and 43 μm or more (corresponding the diameters of powder which can pass a sieve with 325 mesh).

In the manufacture of iron alloy powder containing chromium or the like which is easily subject to oxidization, silicon is added as an deoxidizing agent into the molten melt of the iron alloy powder. However, when the silicon is solid-solved in the iron base material of the sintered alloy, the iron base material is hardened which is unfavorable effect/function. Here, since the iron alloy powder A contain the preliminarily precipitated carbides, the hardness in the iron alloy powder A is inherently large. In contrast, since the iron alloy powder B is soft powdery materials, the iron alloy powder B is mixed with the iron alloy powder A so as to ensure the compactibility of the raw material powder composed of the iron alloy powder A and the iron alloy powder B. In the manufacturing method of the sintered alloy of the present invention, therefore, a large amount of silicon, which is easily subject to oxidization, is contained in the inherently hard iron alloy powder so as to apply the effect/function of the silicon to the sintered alloy.

In this point of view, the silicon is contained in the iron alloy powder A within a range of 1.0 to 3.0 mass %. If the content of the silicon to be contained in the iron alloy powder A is set to less than 1.0 mass %, the effect/function of the silicon cannot be exhibited sufficiently. On the other hand, if the content of the silicon to be contained in the iron alloy powder A is set to more than 3.0 mass %, the iron alloy powder A become too hard so as to remarkably deteriorate the compressibility of the iron alloy powder A.

The silicon is not contained in the iron alloy powder B in view of the compressibility of the iron alloy powder B. However, since the iron alloy powder B contain the chromium easily subject to oxidization, the silicon of 1.0 mass % or less may be allowed as unavoidable impurity in the iron alloy powder B because the silicon can be used as a deoxidizing agent in the manufacture of the iron alloy powder.

In order to generate liquid phase in the iron alloy powders A and B during sintering and thus to promote the densification of the sintered alloy, phosphorus is added in the form of iron-phosphorus powder. The phosphorus generates Fe—P—C liquid phase with the carbon during sintering to promote the densification of the sintered alloy. Therefore, the sintered alloy with a density ratio of 90% or more can be obtained. If the content of the phosphorus in the iron-phosphorus alloy powder is set less than 10 mass %, the liquid phase is not generated sufficiently so as not to contribute to the densification of the sintered alloy. On the other hand, if the content of the phosphorus in the iron-phosphorus alloy powder is set more than 30 mass %, the hardness in the iron-phosphorus powder is increased so as to remarkably deteriorate the compressibility in the iron alloy powder A and the iron alloy powder B.

If the additive amount of the iron-phosphorus alloy powder to the mixture of the iron alloy powder A and iron alloy powder B is less than 1.0 mass %, the density ratio of the sintered alloy becomes lower than 90%. On the other hand, if the additive amount of the iron-phosphorus alloy powder to the mixture of the iron alloy powder A and iron alloy powder B is more than 5.0 mass %, excess liquid phase is generated so as to cause the losing shape of the sintered alloy during sintering. Therefore, the iron-phosphorus alloy powder containing the phosphorus within a range of 10 to 30 mass % is used while the additive amount of the iron-phosphorus alloy powder to the mixture of the iron alloy powder A and the iron alloy powder B is set within a range of 1.0 to 5.0 mass %. Although the iron-phosphorus alloy powder generates the aforementioned Fe—P—C liquid phase, the thus generated Fe—P—C liquid phase is diffused and absorbed in the iron base material of the mixture of the iron alloy powder A and the iron alloy powder B.

In this manner, the raw material powder is composed of the iron alloy powder A, the iron alloy powder B, the graphite powder, the nickel powder and the iron-phosphorus alloy powder. As described above, the iron alloy powder A including, in percentage by mass, Cr: 25 to 45, Ni: 5 to 15, Si: 1.0 to 3.0, C: 0.5 to 4.0 and the balance of Fe plus unavoidable impurities. The iron alloy powder B including, in percentage by mass, Cr: 12 to 25, Ni: 5 to 15 and the balance of Fe plus unavoidable impurities. Moreover, the iron-phosphorus powder including, in percentage by mass, P:10 to 30 and the balance of Fe plus unavoidable impurities.

Among the raw material powder, the iron alloy powder A forms the phase A containing the larger dispersed carbides, and the iron alloy powder B forms the phase B containing the smaller dispersed carbides. Moreover, the graphite powder and the iron-phosphorus alloy powder generates the Fe—P—C liquid phase so as to contribute to the densification of the sintered alloy, and then diffused and absorbed in the iron base material of the sintered alloy which is made of the phase A and the phase B. By setting the ratio of the iron alloy powder A to the total of the iron alloy powder A and the iron alloy powder B within a range of 20 to 80 mass %, the ratio of the phase A to the total of the phase A and the phase B can be set within a range of 20 to 80% relative to the cross sectional area of the sintered alloy, that is, the base material of the sintered alloy.

In this manner, the iron alloy powder A and the iron alloy powder B are added so that the ratio of the iron alloy powder A to the total of the iron alloy powder A and the iron alloy powder B is set within a range of 20 to 80 mass % while the iron-phosphorus alloy powder of 1.0 to 5.0 mass %, the nickel powder of 1 to 12 mass % and the graphite powder of 0.5 to 2.5 mass % are added, thereby forming the intended raw material powder.

As is conducted from the past, the raw material powder is filled into the cavity formed by a die assembly with a die hole forming the outer shape of a component, a lower punch slidably fitted in the die hole of the die assembly and forming the lower end shape of the component, and score rod forming the inner shape of the component or the lightening shape of the component as the case may be, and compressed by an upper punch forming the upper end shape and the lower punch. The thus obtained compact is pulled out of the die hole of the die assembly. The manufacturing method is called as "pressing process".

The compact is heated and sintered in a sintering furnace. The heating temperature, that is, the sintering temperature significantly affects the sintering process and the growing processes of carbides. If the sintering temperature is lower than 1000° C., the Fe—P—C liquid phase cannot be generated sufficiently so as not to densify the sintered alloy sufficiently and thus decrease the density of the sintered alloy, resulting in the deterioration of the wear resistance and the corrosion resistance of the sintered alloy while the sizes of the carbides can be maintained within a predetermined range. On the other hand, if the sintering temperature is higher than 1200° C., element diffusion is progressed so that the differences in content of some elements (particularly, chromium and carbon) between of the phase A made of the iron alloy powder A and the phase B made of the iron alloy powder B becomes smaller and the carbides to be precipitated and dispersed in the phase B grows beyond 10 μm as an average particle diameter, resulting in the deterioration of the wear resistance of the sintered alloy while the density of the sintered alloy is increased sufficiently. Therefore, the sintering temperature is set within a range of 1000 to 1200° C.

By compressing and sintering the raw material powder as described above, the sintered alloy having the aforementioned metallic structure can be obtained. The sintered alloy includes, in percentage by mass, Cr: 11.75 to 39.98, Ni: 5.58 to 24.98, Si: 0.16 to 2.54, P; 0.1 to 1.5, C: 0.58 to 3.62 and the balance of Fe plus unavoidable impurities, originated from the mixing ratio of the aforementioned material powder.

Since the phase A of the sintered alloy is made of the iron alloy powder A as described above, the dimensions of the phase A can be controlled by adjusting the particle diameters of the iron alloy powder A. In order that the maximum dimension of the phase A is set to 500 μm or less, the maximum particle size of the iron alloy powder A is set to 300 μm or less (corresponding to the size of a powder passing a sieve with 50 mesh). In order that the dimension of the phase A is set to 100 μm or more, it is required that the iron alloy powder A containing 5 mass % or more of the powder having the maximum particle diameter of 500 μm or less (corresponding the size passing a sieve with 32 mesh) and 100 μm or more (corresponding the size not passing a sieve with 149 mesh) is used.

The preferred particle distribution of the iron alloy powder A is to contain 5 mass % or more of the powder having the maximum particle diameter within a range of 100 to 300 μm and to contain 50 mass % or less of the powder having the particle diameter within a range of 45 μm or less.

The particle diameter of the iron alloy powder B forming the phase B containing the smaller dispersed carbides is not restricted, but the iron alloy powder B preferably contain 90% or more of the powder having a particle distribution of 100 mesh or less.

The sintered alloy further includes at least one selected from the group consisting of Mo, V, W, Nb and Ti. Since Mo, V, W, Nb and Ti have respective higher carbide-forming performances than Cr as carbide-forming elements, these elements can preferentially form carbides as compared with Cr. Therefore, if the sintered alloy includes these elements, the decrease in content of Cr of the base material can be prevented so as to contribute to the enhancement of the wear resistance and the corrosion resistance of the base material. Moreover, one or more of these elements are bonded with carbon to form metallic carbides, thereby enhancing the wear resistance of the base material, that is, the sintered alloy. However, if one or more of these elements are added to the raw material powder in the form of pure metallic powder, the thus formed alloys are small in diffusion velocity so that the one or more of these elements are unlikely to be diffused in the base material uniformly. Therefore, the one or more of these elements are preferably added in the form of iron alloy powder. In this point of view, when in the manufacturing method of the present invention the one or more of these elements are added as an additional element(s), the one or more of these elements are solid-solved in the iron alloy powder A and the iron alloy powder B. If the amount of the one or more of these elements to be solid-solved in the iron alloy powder is beyond 5.0 mass %, the deterioration of the compressibility in the iron alloy powder A and the iron alloy powder B is concerned because the excess addition of the one or more of those elements hardens the iron alloy powder A and the iron alloy powder B. Therefore, 5 mass % or less of at least one selected from the group consisting of Mo, V, W, Nb and Ti is added in either or both of the iron alloy powder A and the iron alloy powder B.

EXAMPLES

Example 1

The iron alloy powder A including, in percentage by mass, Cr: 34, Ni: 10, Si: 2, C: 2 and the balance of Fe plus unavoidable impurities, the iron alloy powder B including, in percentage by mass, Cr: 18, Ni: 8 and the balance of Fe plus unavoidable impurities, the iron-phosphorus powder including, in percentage by mass, P: 20 and the balance of Fe plus unavoidable impurities, the nickel powder and the graphite powder were prepared and mixed with one another at the ratios shown in Table 1 to blend the raw material powder. The raw material powder was compressed in the shape of pillar with an outer diameter of 10 mm and a height of 10 mm and in the shape of thin plate with an outer diameter of 24 mm and a height of 8 mm, and then sintered at a temperature of 1100° C. under non-oxidizing atmosphere to form sintered samples indicated by numbers of 01 to 11. The composition in each of the sintered samples was listed in Table 1 with the aforementioned ratios of the material powder to be prepared.

Figure 2:
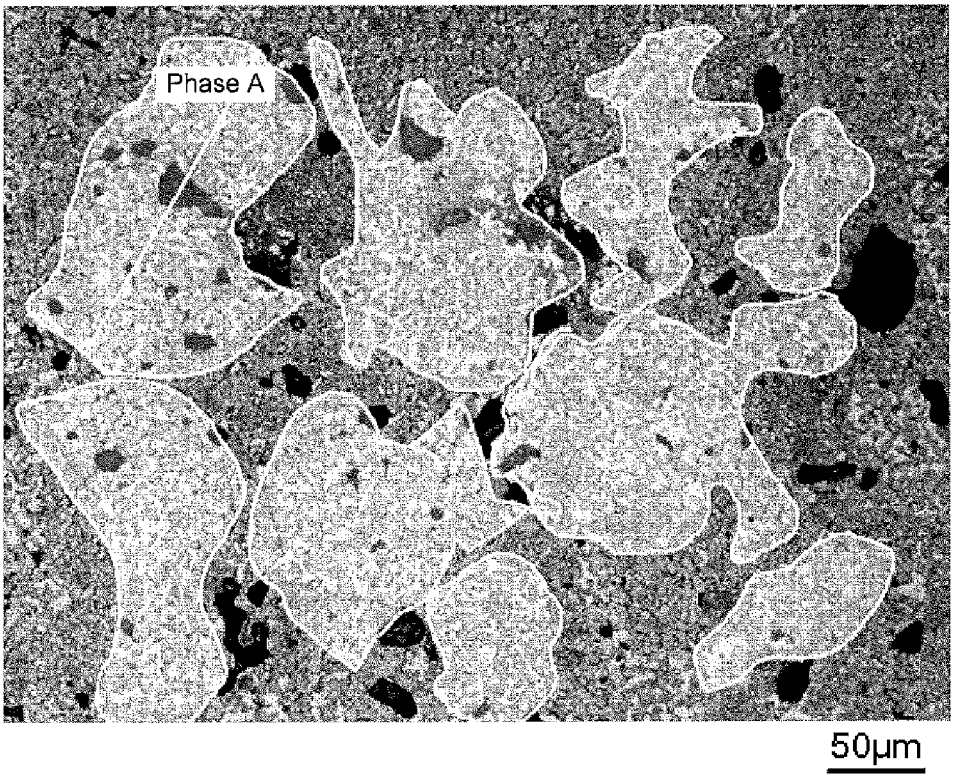
FIG. 2 is a view showing the area of the phase A in the metallic structure photograph.

The cross sections of the sintered samples in the shape of pillar were mirror-polished and corroded with royal water (sulfuric acid:nitric acid=1:3) so that the metallic structures of the cross sections of the sintered samples were observed by a microscope of 200 magnifications and analyzed in image by an image processor (WinROOF, made by MITANI CORPORATION) so as to measure the particle diameters of carbides in of the phase and calculate the average particle diameters thereof, and so as to measure the areas and dimensions of the phase A and calculate the area ratio and maximum dimension thereof. FIG. 1 is a metallic structure photograph of the sintered sample 06. As shown in FIG. 2, the areas where the larger carbides were dispersed were enclosed and the thus enclosed areas were defined as the respective phase A. Then, the area ratio of the phase A was calculated and the maximum length of the phase A was defined as the maximum diameter in the phase A.

The sintered samples were heated at a temperature of 700° C. so as to investigate the thermal expansion coefficients thereof. Moreover, the sintered samples were heated within a temperature range of 850 to 950° C. under atmosphere so as to investigate the increases in weight thereof after heating. The results were listed in Table 2.

Then, the sintered samples in the shape of thin plate were used as disc members and tested in abrasion by using a rolling member with an outer diameter of 15 mm and a length of 22 mm and made of chromized JIS SUS 316L as the opponent member under the roll-on-disc abrasion test where the sintered samples were slid repeatedly on the rolling member at a temperature of 700° C. during 15 minutes. The abrasion results were also listed in Table 2.

Note that the sintered samples having the thermal expansion coefficients of $16\times10^{-6}K^{-1}$ or more, the abrasion depth of 2 μm or less, the weight increase due to oxidization of 10 $g/m^2$ or less at a temperature of 850° C., 15 $g/m^2$ or less at a temperature of 900° C. and 20 $g/m^2$ or less at a temperature of 950° C. pass the aforementioned tests.

TABLE 1

| Sintered Sample | Mixing ratio mass % Iron alloy powders A | Iron alloy powders B | Nickel powders | Iron-phosphorous alloy powders | Graphite powders | A/B % | Composition, mass % Fe | Cr | Ni | Si | P | C |
|---|---|---|---|---|---|---|---|---|---|---|---|---|
| 01 | 0.0 | 91.0 | 5.0 | 2.5 | 1.5 | 0 | Balance | 16.38 | 12.28 | 0.00 | 0.50 | 1.30 |
| 02 | 9.1 | 81.9 | 5.0 | 2.5 | 1.5 | 10 | Balance | 17.84 | 12.46 | 0.18 | 0.50 | 1.48 |
| 03 | 18.2 | 72.8 | 5.0 | 2.5 | 1.5 | 20 | Balance | 19.29 | 12.64 | 0.36 | 0.50 | 1.66 |
| 04 | 27.3 | 63.7 | 5.0 | 2.5 | 1.5 | 30 | Balance | 20.75 | 12.83 | 0.55 | 0.50 | 1.85 |
| 05 | 36.4 | 54.6 | 5.0 | 2.5 | 1.5 | 40 | Balance | 22.20 | 13.01 | 0.73 | 0.50 | 2.03 |
| 06 | 45.5 | 45.5 | 5.0 | 2.5 | 1.5 | 50 | Balance | 23.66 | 13.19 | 0.91 | 0.50 | 2.21 |
| 07 | 54.6 | 36.4 | 5.0 | 2.5 | 1.5 | 60 | Balance | 25.12 | 13.37 | 1.09 | 0.50 | 2.39 |
| 08 | 63.7 | 27.3 | 5.0 | 2.5 | 1.5 | 70 | Balance | 26.57 | 13.55 | 1.27 | 0.50 | 2.57 |
| 09 | 72.8 | 18.2 | 5.0 | 2.5 | 1.5 | 80 | Balance | 28.03 | 13.74 | 1.46 | 0.50 | 2.76 |
| 10 | 81.9 | 9.1 | 5.0 | 2.5 | 1.5 | 90 | Balance | 29.48 | 13.92 | 1.64 | 0.50 | 2.94 |
| 11 | 91.0 | 0.0 | 5.0 | 2.5 | 1.5 | 100 | Balance | 30.94 | 14.10 | 1.82 | 0.50 | 3.12 |

TABLE 2

| Sintered sample | Average particle Diameter of carbide [μm] Phase A | Phase B | Area ratio of phase A, % | Maximum diameter of phase A, μm | Thermal expansion coefficient, $10^{-6}K^{-1}$ | Average abrasion depth, μm | Increase in weight due to oxidization, $g/m^2$ 850° C. | 900° C. | 950° C. | Note |
|---|---|---|---|---|---|---|---|---|---|---|
| 01 | — | 3 | 0 | — | 17.7 | 2.4 | 16 | 26 | 32 | Area ratio of phase A less than lower limited value. |
| 02 | 15 | 4 | 10 | 200 | 17.5 | 1.8 | 13 | 20 | 26 | Area ratio of phase A less than lower limited value. |
| 03 | 16 | 4 | 21 | 220 | 174 | 1.3 | 10 | 14 | 20 | Area ratio of phase A equal to lower limited value. |
| 04 | 16 | 4 | 32 | 230 | 17.2 | 1.3 | 7 | 10 | 17 | |
| 05 | 17 | 4 | 41 | 240 | 16.8 | 1.2 | 5 | 8 | 14 | |
| 06 | 17 | 4 | 49 | 240 | 16.5 | 1.2 | 4 | 7 | 11 | |
| 07 | 17 | 4 | 61 | 260 | 16.4 | 1.2 | 3 | 6 | 10 | |
| 08 | 18 | 5 | 68 | 280 | 16.3 | 1.3 | 3 | 5 | 9 | |
| 09 | 18 | 5 | 78 | 300 | 16.3 | 1.4 | 3 | 5 | 10 | Area ratio of phase A equal to upper limited value. |
| 10 | 18 | 6 | 88 | 350 | 16.2 | 2.1 | 5 | 10 | 14 | Area ratio of phase A more than upper limited value. |
| 11 | 18 | — | 95 | 600 | 16.1 | 2.3 | 8 | 15 | 26 | Area ratio of phase A more than upper limited value. |

The effect/function of the ratio of the iron alloy powder A and the iron alloy powder B can be recognized from Tables 1 and 2. In the sintered sample 01 not containing the iron alloy powder A so that the ratio (A/A+B) of the iron alloy powder A to the total of the iron alloy powder A and the iron alloy powder B is set to zero, no phase A containing the larger dispersed carbides, which are made of the iron alloy powder A, exist. Hence, the sintered sample 01 exhibits a thermal expansion coefficient of $17.7\times10^{-6}K^{-1}$ similar to that of an austenitic heat-resistant material. However, since the iron alloy powder B contain a smaller amount of chromium and no carbon, the sizes of the precipitated carbides in the sintered sample 01 become small at 3 μm and thus the abrasion depth of the sintered sample 01 becomes large beyond 2 μm. Moreover, since the content of chromium relative to the composition of the sintered sample 01 is poor, chromium contained in the sintered sample 01 is partially precipitated as chromium carbides so that the content of chromium solid-solved in the sintered sample 01 becomes insufficient. Consequently, the sintered sample 01 is increased in weight due to oxidization and deteriorated in corrosion resistance.

In the sintered sample 11 not containing the iron alloy powder B so that the ratio (A/A+B) of the iron alloy powder A to the total of the iron alloy powder A and the iron alloy powder B is set to 100%, only the phase A containing the larger dispersed carbides within a range of 15 to 18 μm, which are made of the iron alloy powder A, exist. Hence, the thermal expansion coefficient of the sintered sample 11 is decreased to $16.1\times10^{-6}K^{-1}$, but still similar to that of an austenitic heat-resistant material, so that the sintered sample 11 has a thermal expansion coefficient enough to be practically applied. Moreover, since only the iron alloy powder A containing larger amounts of chromium and carbon are used for the manufacture of the sintered sample 11 and the carbon is additionally added to the sintered sample 11 by supplying the graphite powder to the iron alloy powder A, the contents of the carbides precipitated in the base material of the sintered sample 11 is increased, resulting in the increase of attack on the opponent component (rolling member). As the result that the abrasion powder of the opponent component serve as abrading agents, the abrasion depth of the sintered sample 11 is increased. Furthermore, the amount of chromium to be solid solved in the base material of the sintered sample 11 becomes insufficient as the amount of the chromium carbides precipitated in the base material is increased so that the sintered sample 11 is increased in weight due to oxidization, resulting in the deterioration of the corrosion resistance of the sintered sample 11.

In the sintered samples 02 to 10 made of the mixture of the iron alloy powder A and the iron alloy powder B, the phase A containing the larger dispersed carbides within a range of 15 to 18 μm exist so that the sintered samples 02 to 10 exhibit the respective metallic structures such that the ratio of the phase A to the total of the phase A and the phase B is increased as the ratio of the iron alloy powder A to the total of the iron alloy powder A and the iron alloy powder B is increased. Moreover, the thermal expansion coefficients of the sintered samples 02 to 10 are likely to be decreased as the ratio of the phase A therein are increased. However, since the sintered samples 02 to 10 exhibit $16\times10^{-6}K^{-1}$ still similar to that of an austenitic heat-resistant material, the sintered samples 02 to 10 have the respective thermal expansion coefficients enough to be practically applied.

FIG. 1 is a metallic structure photograph of the sintered sample 06. As is apparent from FIG. 1, it is turned out that the sintered sample 06 has the metallic structure such that the phase A containing the larger dispersed carbides with an average particle diameter of 17 μm are randomly dispersed in the phase B containing the smaller dispersed carbides with an average particle diameter of 4 μm.

The abrasion depths of the sintered samples are likely to be decreased due to the increases in corrosion resistance thereof as the ratio of the phase A containing the larger dispersed carbides is increased, which is originated from that the increase of the ratio of the phase A containing the larger dispersed carbides causes the decrease of the phase B containing the smaller dispersed carbides and the increase of attack on the opponent component (rolling member) so that the abrasion powder of the opponent component serve as the abrading agents so as to increase the abrasion depths of the sintered samples.

Moreover, as the result that the amounts of chromium in the sintered samples are entirely increased as the ratio of the iron alloy powder A containing a larger amount of chromium is increased and the ratio of the iron alloy powder B containing a smaller amount of chromium is decreased, the large amounts of the chromium are solid-solved in the base materials of the corresponding sintered samples so as to enhance the corrosion resistances thereof and decrease the weights thereof due to oxidization even though the precipitation amount of the chromium carbides is increased. However, if the ratio of the iron alloy powder A is more than 50%, the amount of carbon to be contained in the mixture of the iron alloy powder A and the iron alloy powder B is increased as the ratio of the iron alloy powder A is increased, causing the increases in precipitation of the chromium carbides and the shortage of the amount of chromium to be solid-solved in the base materials of the sintered samples, and thus causing the increases in weight of the sintered samples due to oxidization and the decreases in corrosion resistance of the sintered samples.

In view of the aforementioned wear resistance and corrosion resistance, it is preferable that the ratio of the phase A is set within a range of 20 to 80% relative to the base material of the sintered samples by setting the ratio (A/A+B) of the iron alloy powder A to the total of the iron alloy powder A and the iron alloy powder B within a range of 20 to 80%, which causes the enhancement of the wear resistance and corrosion resistance of each of the sintered samples. More preferably, the ratio of the (A/A+B) of the iron alloy powder A to the total of the iron alloy powder A and the iron alloy powder B is set within a range of 40 to 60% so that the ratio of the phase A is set within a range of 40 to 60% relative to the base material of the sintered samples.

Example 2

The iron alloy powders A having the respective components shown in Table 3 were prepared, and mixed with the iron alloy powder B, the iron-phosphorus alloy powder, the nickel powder and the graphite powder which were used in Example 1 at the ratios shown in Table 3 to blend the respective raw material powder. The thus obtained raw material powder was compressed and sintered in the same manner as in Example 1 to form sintered samples 12 to 30 in the shape of pillar and in the shape of thin plate. The total components of the sintered samples were listed in Table 3. With respect to the sintered samples, the average particle diameters of carbides in the phase A and the phase B, the ratio of the phase A, the maximum dimension of the phase A, the thermal expansion coefficients, the increases in weight after oxidizing test and the abrasion depths after roll-on-disc abrasion test were measured in the same manner as in Example 1. The results were listed in Table 4 with the results of the sintered sample 06 obtained in Example 1.

TABLE 3

| | Mixing ratio, mass % | | | | | | | | | | | | | | | | |
|---|---|---|---|---|---|---|---|---|---|---|---|---|---|---|---|---|---|
| | Iron alloy powders A | | | | | | Iron-alloy powders | Nickel | Iron-Phosphorus alloy | Graphite | A/B | Composition, mass % | | | | | |
| Sintered sample | | Composition, mass % | | | | | B | Powders | powders | powders | % | | | | | | |
| | | Fe | Cr | Ni | Si | C | | | | | | Fe | Cr | Ni | Si | P | C |
| 12 | 45.5 | Balance | 20.0 | 10.0 | 2.0 | 2.0 | 45.5 | 5.0 | 2.5 | 1.5 | 50 | Balance | 17.29 | 13.19 | 0.91 | 0.50 | 2.21 |
| 13 | 45.5 | Balance | 25.0 | 10.0 | 2.0 | 2.0 | 45.5 | 5.0 | 2.5 | 1.5 | 50 | Balance | 19.57 | 13.19 | 0.91 | 0.50 | 2.21 |
| 14 | 45.5 | Balance | 30.0 | 10.0 | 2.0 | 2.0 | 45.5 | 5.0 | 2.5 | 1.5 | 50 | Balance | 21.84 | 13.19 | 0.91 | 0.50 | 2.21 |
| 06 | 45.5 | Balance | 34.0 | 10.0 | 2.0 | 2.0 | 45.5 | 5.0 | 2.5 | 1.5 | 50 | Balance | 23.66 | 13.19 | 0.91 | 0.50 | 2.21 |
| 15 | 45.5 | Balance | 40.0 | 10.0 | 2.0 | 2.0 | 45.5 | 0 | 2.5 | 1.5 | 50 | Balance | 26.39 | 13.19 | 0.91 | 0.50 | 2.21 |
| 16 | 45.5 | Balance | 45.0 | 10.0 | 2.0 | 2.0 | 45.5 | 5.0 | 2.5 | 1.5 | 50 | Balance | 28.67 | 13.19 | 0.91 | 0.50 | 2.21 |
| 17 | 45.5 | Balance | 50.0 | 10.0 | 2.0 | 2.0 | 45.5 | 5.0 | 2.5 | 1.5 | 50 | Balance | 30.94 | 13.19 | 0.91 | 0.50 | 2.21 |
| 18 | 45.5 | Balance | 34.0 | 0.0 | 2.0 | 2.0 | 45.5 | 5.0 | 2.5 | 1.5 | 50 | Balance | 23.66 | 8.64 | 0.91 | 0.50 | 2.21 |
| 19 | 45.5 | Balance | 34.0 | 5.0 | 2.0 | 2.0 | 45.5 | 5.0 | 2.5 | 1.5 | 50 | Balance | 23.66 | 10.92 | 0.91 | 0.50 | 2.21 |
| 06 | 45.5 | Balance | 34.0 | 10.0 | 2.0 | 2.0 | 45.5 | 5.0 | 2.5 | 1.5 | 50 | Balance | 23.66 | 13.19 | 0.91 | 0.50 | 2.21 |
| 20 | 45.5 | Balance | 34.0 | 15.0 | 2.0 | 2.0 | 45.5 | 5.0 | 2.5 | 1.5 | 50 | Balance | 23.66 | 15.47 | 0.91 | 0.50 | 2.21 |
| 21 | 45.5 | Balance | 34.0 | 20.0 | 2.0 | 2.0 | 45.5 | 5.0 | 2.5 | 1.5 | 50 | Balance | 23.66 | 17.74 | 0.91 | 0.50 | 2.21 |
| 22 | 45.5 | Balance | 34.0 | 10.0 | 2.0 | 0.0 | 45.5 | 5.0 | 2.5 | 1.5 | 50 | Balance | 23.66 | 13.19 | 0.91 | 0.50 | 1.30 |

TABLE 3-continued

| Sintered sample | Mixing ratio, mass % | | | | | | | | | | | | | | | | |
|---|---|---|---|---|---|---|---|---|---|---|---|---|---|---|---|---|---|
| | Iron alloy powders A | | | | | | Iron-alloy powders | Nickel Powders | Iron-Phosphorus alloy powders | Graphite powders | A/B % | Composition, mass % | | | | | |
| | | Composition, mass % | | | | | | | | | | | | | | | |
| | | Fe | Cr | Ni | Si | C | B | | | | | Fe | Cr | Ni | Si | P | C |
| 23 | 45.5 | Balance | 34.0 | 10.0 | 2.0 | 0.5 | 45.5 | 5.0 | 2.5 | 1.5 | 50 | Balance | 23.66 | 13.19 | 0.91 | 0.50 | 1.53 |
| 24 | 45.5 | Balance | 34.0 | 10.0 | 2.0 | 1.0 | 45.5 | 5.0 | 2.5 | 1.5 | 50 | Balance | 23.66 | 13.19 | 0.91 | 0.50 | 1.76 |
| 25 | 45.5 | Balance | 34.0 | 10.0 | 2.0 | 1.5 | 45.5 | 5.0 | 2.5 | 1.5 | 50 | Balance | 23.66 | 13.19 | 0.91 | 0.50 | 1.98 |
| 06 | 45.5 | Balance | 34.0 | 10.0 | 2.0 | 2.0 | 45.5 | 5.0 | 2.5 | 1.5 | 50 | Balance | 23.66 | 13.19 | 0.91 | 0.50 | 2.21 |
| 26 | 45.5 | Balance | 34.0 | 10.0 | 2.0 | 2.5 | 45.5 | 5.0 | 2.5 | 1.5 | 50 | Balance | 23.66 | 13.19 | 0.91 | 0.50 | 244 |
| 27 | 45.5 | Balance | 34.0 | 10.0 | 2.0 | 3.0 | 45.5 | 5.0 | 2.5 | 1.5 | 50 | Balance | 23.66 | 13.19 | 0.91 | 0.50 | 2.67 |
| 28 | 45.5 | Balance | 34.0 | 10.0 | 2.0 | 4.0 | 45.5 | 5.0 | 2.5 | 1.5 | 50 | Balance | 23.66 | 13.19 | 0.91 | 0.50 | 3.12 |
| 29 | 45.5 | Balance | 34.0 | 10.0 | 2.0 | 4.5 | 45.5 | 5.0 | 2.5 | 1.5 | 50 | Balance | 23.66 | 13.19 | 0.91 | 0.50 | 3.35 |
| 30 | 45.5 | Balance | 34.0 | 10.0 | 2.0 | 5.0 | 45.5 | 5.0 | 2.5 | 1.5 | 50 | Balance | 23.66 | 13.19 | 0.91 | 0.50 | 3.58 |

TABLE 4

| Sintered sample | Average particle Diameter of carbide [μm] | | Area ratio of phase | Maximum diameter of phase | Thermal expansion coefficient, | Average abrasion depth, | Increase in weight due to oxidization, g/m$^2$ | | | Note |
|---|---|---|---|---|---|---|---|---|---|---|
| | Phase A | Phase B | A, % | A, μm | $10^{-6}K^{-1}$ | μm | 850° C. | 900° C. | 950° C. | |
| 12 | 8 | 3 | 20 | 220 | 17.4 | 2.1 | 14 | 22 | 28 | Content of Cr in iron alloy powders A less than lower limited value. |
| 13 | 12 | 3 | 25 | 220 | 17.3 | 1.5 | 9 | 13 | 20 | Content of Cr in iron alloy powders A equal to lower limited value. |
| 14 | 15 | 4 | 35 | 230 | 17.0 | 1.3 | 5 | 9 | 15 | |
| 06 | 17 | 4 | 49 | 240 | 16.5 | 1.2 | 4 | 7 | 11 | |
| 15 | 19 | 4 | 52 | 230 | 16.3 | 1.2 | 3 | 6 | 9 | |
| 16 | 21 | 4 | 57 | 250 | 16.2 | 1.2 | 3 | 5 | 7 | Content of Cr in iron alloy powders A equal to upper limited value. |
| 17 | — | — | — | — | — | — | — | — | — | Content of Cr in iron alloy powders A more than upper limited value, not formable. |
| 18 | 18 | 4 | 51 | 245 | 14.2 | 1.4 | 3 | 6 | 10 | Content of Ni in iron alloy powders A less than lower limited value. |
| 19 | 18 | 5 | 50 | 240 | 16.4 | 1.3 | 4 | 7 | 11 | Content of Ni in iron alloy powders A equal to lower limited value. |
| 06 | 17 | 4 | 49 | 240 | 16.5 | 1.2 | 4 | 7 | 11 | |
| 20 | 17 | 4 | 49 | 243 | 16.6 | 1.2 | 4 | 7 | 11 | Content of Ni in iron alloy powders A equal to upper limited value |
| 21 | 17 | 4 | 50 | 242 | 16.6 | 1.3 | 4 | 7 | 11 | Content of Ni in iron alloy powders A more than upper limited value. |
| 22 | 4 | 2 | 40 | 150 | 16.2 | 2.6 | 2 | 3 | 6 | Content of C in iron alloy powders A less than lower limited value. |
| 23 | 10 | 2 | 42 | 200 | 16.3 | 1.8 | 2 | 3 | 6 | Content of C in iron alloy powders A equal to lower limited value. |
| 24 | 12 | 3 | 44 | 220 | 16.4 | 1.6 | 3 | 4 | 8 | |
| 25 | 15 | 4 | 46 | 220 | 16.4 | 1.4 | 4 | 6 | 9 | |
| 06 | 17 | 4 | 49 | 240 | 16.5 | 1.2 | 4 | 7 | 11 | |
| 26 | 20 | 4 | 53 | 260 | 16.6 | 1.0 | 5 | 8 | 11 | |
| 27 | 30 | 5 | 57 | 270 | 16.7 | 0.9 | 5 | 8 | 12 | |
| 28 | 50 | 6 | 63 | 300 | 16.7 | 0.8 | 10 | 14 | 19 | Content of C in iron alloy powders A equal to upper limited value. |
| 29 | 60 | 7 | 66 | 320 | 16.8 | 0.7 | 13 | 18 | 25 | Content of C in iron alloy powders A more than upper limited value. |

TABLE 4-continued

| Sintered sample | Average particle Diameter of carbide [μm] Phase A | Phase B | Area ratio of phase A, % | Maximum diameter of phase A, μm | Thermal expansion coefficient, $10^{-6}K^{-1}$ | Average abrasion depth, μm | Increase in weight due to oxidization, g/m$^2$ 850° C. | 900° C. | 950° C. | Note |
|---|---|---|---|---|---|---|---|---|---|---|
| 30 | — | — | — | — | — | — | — | — | — | Content of Cr in iron alloy powders A more than upper limited value, not formable. |

From the sintered samples 06 and 12 to 17 in Tables 3 and 4, it is recognized that the effect/function of the amount of chromium of the iron alloy powder A can be recognized. In the sintered sample 12 made of the iron alloy powder A containing 20 mass % of chromium, since the content of chromium contained in the iron alloy powder A is small, the sizes of the chromium carbides precipitated in the phase A become small within a range of less than 10 μm as average particle size, and the ratio of the phase A occupied in the base material is decreased because the chromium contained in the iron alloy powder A is diffused in the phase B made of the iron alloy powder B during sintering. Therefore, the wear resistance of the sintered sample 12 is decreased so that the abrasion depth becomes large within a range of more than 2 μm. In the phase A of the sintered sample 12 made of the iron alloy powder A containing the smaller amount of chromium, the content of chromium to be solid-solved in the phase A is decreased due to the precipitations of the chromium carbides, resulting in the deterioration in corrosion resistance of the phase A and thus the increase in weight due to oxidization.

On the other hand, in the sintered samples 06 and 13 to 16 made of the iron alloy powder A containing chromium within a range of 25 to 45 mass %, the amount of chromium is added sufficiently so that the larger carbides more than 10 μm are precipitated. The particle diameters of the chromium carbides are likely to be increased as the content of chromium contained in the iron alloy powder A is increased. Moreover, the ratio of the phase A and the maximum diameter of the phase A are also increased as the content of chromium contained in the iron alloy powder A is increased. The precipitation of the chromium carbides and the increase in ratio of the phase A cause the improvements in abrasion depth of the wintered samples up to 2 μm or less, which exhibits the decrease in abrasion depth of the sintered samples as the content of chromium contained in the iron alloy powder A is increased. In the sintered samples 06 and 13 to 16 made of the iron alloy powder A containing the chromium within a range of 25 to 45 mass %, moreover, the sufficient amount of the chromium is solid-solved in the phase, thereby enhancing the wear resistances of the phase A of the sintered samples and thus reducing the increases of the sintered samples in weight due to oxidization. Namely, the increases of the sintered samples in weight due to oxidization can be more reduced with the increase of the amount of the chromium contained in the iron alloy powder A.

However, the hardness of the iron alloy powder A is increased as the content of the chromium contained in the iron alloy powder A is increased, and in the sintered sample 17 made of the iron alloy powder A containing 45 mass % or more of the chromium, the iron alloy powder A become too hard and cannot be compressed in the corresponding compressing process, and cannot be shaped.

Since the thermal expansion coefficients of the sintered samples are likely to be decreased as the content of the chromium is increased, and even the sintered sample 16, made of the iron alloy powder A containing 45 mass of the chromium, has a practically usable one of more than $16\times10^{-6}K^{-1}$.

In this manner, it is confirmed that the particle sizes of the metallic carbides in the phase A are required to be more than 10 μm. Moreover, it is confirmed that the content of the chromium contained in the iron alloy powder A forming the phase A should be set within a range of 25 to 45 mass %.

Referring to the sintered samples 06 and 18 to 21 shown in Tables 3 and 4, the influences of nickel contained in the iron alloy powder A can be recognized. In the sintered sample 18 made of the iron alloy powder A not containing nickel, the nickel powder are added to the iron alloy powder A as described above, but the nickel elements of the nickel powder are not perfectly diffused into the inner areas of the iron alloy powder A so that the phase A is not partially austenitized and the not austenitized areas locally remains in the phase A, thereby decreasing the thermal expansion coefficient up to less than $16\times10^{-6}K^{-1}$.

In the sintered samples 06 and 19 to 21 made of the iron alloy particles A containing 5 mass % or more of nickel, however, the amount of nickel enough to be austenitized is contained so that the phase A, made of the iron alloy powder A, are perfectly austenitized, so that the sintered samples have the respective thermal expansion coefficients practically usable of more than $16\times10^{-6}K^{-1}$.

The nickel elements contained in the iron alloy powder A do not affect the sizes of the carbides in the phase A, the ratio of the phase A, the maximum diameter of the phase A, the sample abrasion depth and the increase in weight of the sample due to oxidization.

In this manner, it is confirmed that the content of the nickel contained in the iron alloy powder A should be set within a range of 5 mass % or more. Since the nickel is expensive, however, the excess use of the nickel results in the increase in cost of the samples, that is, the sintered alloy of the present invention, so that the content of the nickel contained in the iron alloy powder A should be set within a range of 15 mass % or less.

Referring to the sintered samples 06 and 22 to 30 shown in Tables 3 and 4, the influences of carbon contained in the iron alloy powder A can be recognized. In the sintered sample 22 made of the iron alloy powder A not containing carbon, the particle sizes of the chromium carbides precipitated in the phase A made of the iron alloy powder A are miniaturized within a range of 10m or less so that the difference in particle size between the chromium carbides precipitated in the phase A and the carbides precipitated in the phase B becomes small, resulting in the deterioration of the wear resistance of the sintered sample and in the abrasion depth of more than 2 μm of the sintered sample.

On the other hand, in the sintered sample 23 made of the iron alloy powder A containing 0.5 mass % of carbon, the particle sizes of the chromium carbides precipitated in the phase A become about 10 μm so that the difference in particle size between the chromium carbides precipitated in the phase A and the carbides precipitated in the phase B is increased up to 8 μm or so, causing the enhancement of the wear resistance of the sintered sample and decreasing the abrasion depth of the sintered sample up to 2 μm or less. Moreover, the particle sizes of the chromium carbides precipitated in the phase A made of the iron alloy powder A are increased while the carbon elements of the iron alloy powder A are diffused into the iron alloy powder B so that the ratio of the phase A and the maximum diameter of the phase A are likely to be increased as the content of the carbon contained in the iron alloy powder A is increased. Simultaneously, the wear resistances of the sintered samples are enhanced and thus the abrasion depths of the sintered samples are decreased as the content of the carbon contained in the iron alloy powder A is increased.

However, as the result that the content of the chromium solid-solved in the phase A is decreased as the particle sizes of the chromium carbides precipitated in the phase A are increased, the increases in weight of the sintered samples due to oxidization are gradually developed. In the sintered sample 29 made of the iron alloy powder A containing 4.5 mass % of carbon, therefore, the increase in weight of the sintered sample due to oxidization is developed up to more than 10 g/m$^2$ at a temperature of 850° C., up to more than 15 g/m$^2$ at a temperature of 900° C. and up to more than 20 g/m$^2$ at a temperature of 950° C. In the sintered sample 30 made of the iron alloy powder A containing 5 mass % of carbon, moreover, the iron alloy powers A become too hard, cannot be compressed in the corresponding compressing process and cannot be shaped.

As the result that the particle sizes of the chromium carbides precipitated in the phase A are increased so that the amount of the chromium to be solid-solved in the phase A is decreased as the content of the carbon contained in the iron alloy powder A is increased, the thermal expansion coefficients of the sintered samples are gradually increased up to more than $16\times10^{-6}K^{-1}$ within a carbon content range of 0 to 4 mass % which corresponds to the one practically usable.

In this manner, it is confirmed that the particles sizes of the metallic carbides of the phase A are required to be within a range of 10 μm or more and the content of the carbon of the iron alloy powder A forming the phase A should be set within a range of 0.5 to 4 mass %.

Example 3

The iron alloy powders B having the respective compositions shown in Table 5 were prepared, and mixed with the iron alloy powder A, the iron-phosphorus alloy powder, the nickel powder and the graphite powder which were used in Example 1 at the ratios shown in Table 5 to blend the respective raw material powder. The thus obtained raw material powder was compressed and sintered in the same manner as in Example 1 to form sintered samples 31 to 41 in the shape of pillar and in the shape of thin plate. The compositions of the sintered samples were listed in Table 5. With respect to the sintered samples, the average particle diameters of carbides in the phase A and the phase B, the ratio of the phase A, the maximum dimension of the phase A, the thermal expansion coefficients, the increases in weight after oxidizing test and the abrasion depths after roll-on-disc abrasion test were measured in the same manner as in Example 1. The results were listed in Table 6 with the results of the sintered sample 06 obtained in Example 1.

TABLE 5

| | Mixing ratio, mass % | | | | | | | | | | | | | | |
|---|---|---|---|---|---|---|---|---|---|---|---|---|---|---|---|
| | | Iron alloy powders B | | | | | Iron- | | | | | | | | |
| Sintered | Iron alloy powders | | Composition, mass % | | | Nickel | Phosphorus alloy | Graphite | A/B | Composition, mass % | | | | | |
| sample | A | | Fe | Cr | Ni | Powders | powders | powders | % | Fe | Cr | Ni | Si | P | C |
| 31 | 45.5 | 45.5 | Balance | 10.0 | 8.0 | 5.0 | 2.5 | 1.5 | 50 | Balance | 20.02 | 13.19 | 0.91 | 0.50 | 2.21 |
| 32 | 45.5 | 45.5 | Balance | 12.0 | 8.0 | 5.0 | 2.5 | 1.5 | 50 | Balance | 20.93 | 13.19 | 0.91 | 0.50 | 2.21 |
| 33 | 45.5 | 45.5 | Balance | 15.0 | 8.0 | 5.0 | 2.5 | 1.5 | 50 | Balance | 22.30 | 13.19 | 0.91 | 0.50 | 2.21 |
| 06 | 45.5 | 45.5 | Balance | 18.0 | 8.0 | 5.0 | 2.5 | 1.5 | 50 | Balance | 23.66 | 13.19 | 0.91 | 0.50 | 2.21 |
| 34 | 45.5 | 45.5 | Balance | 20.0 | 8.0 | 5.0 | 2.5 | 1.5 | 50 | Balance | 24.57 | 13.19 | 0.91 | 0.50 | 2.21 |
| 35 | 45.5 | 45.5 | Balance | 25.0 | 8.0 | 5.0 | 2.5 | 1.5 | 50 | Balance | 26.85 | 13.19 | 0.91 | 0.50 | 2.21 |
| 36 | 45.5 | 45.5 | Balance | 30.0 | 8.0 | 5.0 | 2.5 | 1.5 | 50 | Balance | 29.12 | 13.19 | 0.91 | 0.50 | 2.21 |
| 37 | 45.5 | 45.5 | Balance | 18.0 | 0.0 | 5.0 | 2.5 | 1.5 | 50 | Balance | 23.66 | 9.55 | 0.91 | 0.50 | 2.21 |
| 38 | 45.5 | 45.5 | Balance | 18.0 | 5.0 | 5.0 | 2.5 | 1.5 | 50 | Balance | 23.66 | 11.83 | 0.91 | 0.50 | 2.21 |
| 06 | 45.5 | 45.5 | Balance | 18.0 | 8.0 | 5.0 | 2.5 | 1.5 | 50 | Balance | 23.66 | 13.19 | 0.91 | 0.50 | 2.21 |
| 39 | 45.5 | 45.5 | Balance | 18.0 | 10.0 | 5.0 | 2.5 | 1.5 | 50 | Balance | 23.66 | 14.10 | 0.91 | 0.50 | 2.21 |
| 40 | 45.5 | 45.5 | Balance | 18.0 | 15.0 | 5.0 | 2.5 | 1.5 | 50 | Balance | 23.66 | 16.38 | 0.91 | 0.50 | 2.21 |
| 41 | 45.5 | 45.5 | Balance | 18.0 | 20.0 | 5.0 | 2.5 | 1.5 | 50 | Balance | 23.66 | 18.65 | 0.91 | 0.50 | 2.21 |

TABLE 6

| Sintered | Average particle Diameter of carbide [μm] | | Area ratio of phase | Maximum diameter of phase | Thermal expansion coefficient, | Average abrasion depth, | Increase in weight due to oxidization, g/m$^2$ | | | |
|---|---|---|---|---|---|---|---|---|---|---|
| sample | Phase A | Phase B | A, % | A, μm | $10^{-6}K^{-1}$ | μm | 850° C. | 900° C. | 950° C. | Note |
| 31 | 16 | 3 | 46 | 250 | 17.1 | 2 | 9 | 16 | 21 | Content of Cr in iron alloy powders B less than lower limited value. |

TABLE 6-continued

| Sintered sample | Average particle Diameter of carbide [μm] Phase A | Phase B | Area ratio of phase A, % | Maximum diameter of phase A, μm | Thermal expansion coefficient, $10^{-6}K^{-1}$ | Average abrasion depth, μm | Increase in weight due to oxidization, g/m² 850° C. | 900° C. | 950° C. | Note |
|---|---|---|---|---|---|---|---|---|---|---|
| 32 | 16 | 3 | 47 | 240 | 16.9 | 1.8 | 7 | 10 | 17 | Content of Cr in iron alloy powders B equal to lower limited value. |
| 33 | 17 | 4 | 48 | 240 | 16.7 | 1.5 | 5 | 8 | 13 | |
| 06 | 17 | 4 | 49 | 240 | 16.5 | 1.2 | 4 | 7 | 11 | |
| 34 | 17 | 6 | 50 | 240 | 16.3 | 1.2 | 3 | 6 | 10 | |
| 35 | 18 | 10 | 51 | 240 | 16.1 | 1.4 | 3 | 5 | 8 | Content of Cr in iron alloy powders B equal to upper limited value. |
| 36 | 18 | 13 | 52 | 230 | 15.9 | 1.7 | 2 | 5 | 7 | Content of Cr in iron alloy powders B more than upper limited value. |
| 37 | 18 | 4 | 44 | 250 | 15.9 | 1.4 | 3 | 7 | 11 | Content of Ni in iron alloy powders B less than lower limited value. |
| 38 | 17 | 4 | 48 | 240 | 16.2 | 1.2 | 4 | 7 | 11 | Content of Ni in iron alloy powders B equal to lower limited value. |
| 06 | 17 | 4 | 49 | 240 | 16.5 | 1.2 | 4 | 7 | 11 | |
| 39 | 18 | 4 | 50 | 230 | 16.7 | 1.2 | 4 | 7 | 11 | |
| 40 | 18 | 4 | 52 | 220 | 16.8 | 1.2 | 5 | 7 | 11 | Content of Ni in iron alloy powders B equal to upper limited value. |
| 41 | 18 | 4 | 52 | 220 | 16.8 | 1.2 | 5 | 7 | 11 | Content of Ni in iron alloy powders B more than upper limited value. |

Referring to the sintered samples 06 and 31 to 36 shown in Tables 5 and 6, the influences of chromium contained in the iron alloy powder B can be recognized. In the sintered sample 31 made of the iron alloy powder B containing less than 12 mass % of chromium, since the content of chromium contained in the iron alloy powder B is small, the content of chromium contained in the phase B made of the iron alloy powder B is decreased so that the corrosion resistance of the phase B is decreased and thus the increase in weight of the sintered sample due to oxidization is developed. On the other hand, in the sintered sample 32 made of the iron alloy powder B containing 12 mass % of chromium, the amount of chromium is added sufficiently so that the increase in weight of the sintered sample due to oxidization is reduced. Moreover, the increases in weight of the sintered samples are likely to be reduced as the content of chromium contained in the iron alloy powder B is increased.

The particle sizes of the chromium carbides precipitated in the phase B are likely to be increased as the content of chromium contained in the iron alloy powder B is increased, and in the sintered sample 35 made of the iron alloy powder B containing 25 mass % of chromium, the particle sizes of the carbides precipitated in the phase B become about 10 μm, and in the sintered sample 36 made of the iron alloy powder B containing more than 25 mass % of chromium, the particle sizes of the carbides precipitated in the phase B become more than 10 μm The abrasion depths of the sintered samples are likely to be decreased as the particle sizes of the chromium carbides precipitated in the phase B are increased, but if the particle sizes of the chromium carbides precipitated in the phase B is more than 6 μm, the differences in particle diameter between the chromium carbides precipitated in the phase B and the carbides precipitated in the phase A become small so that the abrasion depths of the sintered samples are likely to be increased. In the sintered sample 36 containing the chromium carbides of more than 10 μm precipitated in the phase B, the differences in particle diameter between the chromium carbides precipitated in the phase B and the carbides precipitated in the phase A become smaller up to about 5 μm so that the abrasion depth of the sintered sample is remarkably increased.

The thermal expansion coefficients of the sintered samples are likely to be increased as the content of the chromium contained in the iron alloy powder B is increased, and in the sintered sample 36 made of the iron alloy powder B containing more than 25 mass % of the chromium, the thermal expansion coefficient becomes smaller than $16\times10^{-6}K^{-1}$.

In this manner, it is confirmed that the particles sizes of the metallic carbides in the phase B are required to be set to 10 μm or less and the content of the chromium contained in the iron alloy powder B forming the phase B should be set within a range of 12 to 25 mass %.

Referring to the sintered samples 06 and 37 to 41 shown in Tables 5 and 6, the influences of nickel contained in the iron alloy powder B can be recognized. In the sintered sample 37 made of the iron alloy powder B not containing nickel, the nickel powder are added to the iron alloy powder B as described above, but the nickel elements of the nickel powder are not perfectly diffused into the inner areas of the iron alloy powder B so that the phase B is not partially austenitized and the not austenitized areas locally remains in the phase B, thereby decreasing the thermal expansion coefficient up to less than $16\times10^{-6}K^{-1}$.

In the sintered samples 06 and 38 to 41 made of the iron alloy particles B containing 5 mass % or more of nickel, however, the amount of nickel enough to be austenitized is contained in the iron alloy powder B so that the phase B, made of the iron alloy powder B, is perfectly austenitized and thus the sintered samples have the respective thermal expansion coefficients practically usable of more than $16\times10^{-6}K^{-1}$.

The nickel elements contained in the iron alloy powder B do not affect the sizes of the carbides in the phase B and the increase in weight of the sample due to oxidization.

In this manner, it is confirmed that the content of the nickel contained in the iron alloy powder B should be set within a range of 5 mass % or more. Since the nickel is expensive, however, the excess use of the nickel results in the increases in cost of the samples, that is, the sintered alloy of the present invention, so that the content of the nickel contained in the iron alloy powder B should be set within a range of 15 mass % or less.

Example 4

The iron alloy powder A, the iron alloy powder B, the iron-phosphorus alloy powder, the nickel powder and the graphite powder, which were used in Example 1, were prepared and mixed with one another at the ratios shown in Table 7 to blend the respective raw material powder. The thus obtained raw material powder were compressed and sintered in the same manner as in Example 1 to form sintered samples 42 to 60 in the shape of pillar and in the shape of thin plate. The compositions of the sintered samples were listed in Table 7. With respect to the sintered samples, the average particle diameters of carbides in the phase phase A and the phase B, the ratio of the phase A, the maximum dimension of the phase A, the thermal expansion coefficients, the increases in weight after oxidizing test and the abrasion depths after roll-on-disc abrasion test were measured in the same manner as in Example 1. The results were listed in Table 8. In Tables 7 and 8, the results of the sintered sample 06 obtained in Example 1 were listed together.

TABLE 7

| Sintered | Mixing ration, mass % | | | | | A/B | Composition, mass % | | | | | |
|---|---|---|---|---|---|---|---|---|---|---|---|---|
| | Iron alloy powders | Iron alloy powders | Nickel | Iron-phosphorous alloy | Graphite | | | | | | | |
| Sample | A | B | powders | powders | powders | % | Fe | Cr | Ni | Si | P | C |
| 42 | 48.0 | 48.0 | 0.0 | 2.5 | 1.5 | 50 | Balance | 24.96 | 8.64 | 0.96 | 0.50 | 2.26 |
| 43 | 47.5 | 47.5 | 1.0 | 2.5 | 1.5 | 50 | Balance | 24.96 | 9.55 | 0.95 | 0.50 | 2.25 |
| 44 | 46.5 | 46.5 | 3.0 | 2.5 | 1.5 | 50 | Balance | 24.18 | 11.37 | 0.93 | 0.50 | 2.23 |
| 06 | 45.5 | 45.5 | 5.0 | 2.5 | 1.5 | 50 | Balance | 23.66 | 13.19 | 0.91 | 0.50 | 2.21 |
| 45 | 44.3 | 44.3 | 7.5 | 2.5 | 1.5 | 50 | Balance | 23.01 | 15.47 | 0.89 | 0.50 | 2.19 |
| 46 | 43.0 | 43.0 | 10.0 | 2.5 | 1.5 | 50 | Balance | 22.36 | 17.74 | 0.86 | 0.50 | 2.16 |
| 47 | 42.0 | 42.0 | 12.0 | 2.5 | 1.5 | 50 | Balance | 21.84 | 19.56 | 0.84 | 0.50 | 2.14 |
| 48 | 40.5 | 40.5 | 15.0 | 2.5 | 1.5 | 50 | Balance | 21.06 | 22.29 | 0.81 | 0.50 | 2.11 |
| 49 | 46.3 | 46.3 | 5.0 | 2.5 | 0.0 | 50 | Balance | 24.05 | 13.33 | 0.93 | 0.50 | 0.73 |
| 50 | 46.0 | 46.0 | 5.0 | 2.5 | 0.5 | 50 | Balance | 23.92 | 13.28 | 0.92 | 0.50 | 1.22 |
| 51 | 45.8 | 45.8 | 5.0 | 2.5 | 1.0 | 50 | Balance | 23.79 | 13.24 | 0.92 | 0.50 | 1.72 |
| 06 | 45.5 | 45.5 | 5.0 | 2.5 | 1.5 | 50 | Balance | 23.66 | 13.19 | 0.91 | 0.50 | 2.21 |
| 52 | 45.3 | 45.3 | 5.0 | 2.5 | 2.0 | 50 | Balance | 23.53 | 13.15 | 0.91 | 0.50 | 2.71 |
| 53 | 45.0 | 45.0 | 5.0 | 2.5 | 2.5 | 50 | Balance | 23.40 | 13.10 | 0.90 | 0.50 | 3.20 |
| 54 | 44.8 | 44.8 | 5.0 | 2.5 | 3.0 | 50 | Balance | 23.27 | 13.06 | 0.90 | 0.50 | 3.70 |
| 55 | 46.8 | 46.8 | 5.0 | 0.0 | 1.5 | 50 | Balance | 24.31 | 13.42 | 0.94 | 0.00 | 2.24 |
| 56 | 46.3 | 46.3 | 5.0 | 1.0 | 1.5 | 50 | Balance | 24.05 | 13.33 | 0.93 | 0.20 | 2.23 |
| 57 | 45.8 | 45.8 | 5.0 | 2.0 | 1.5 | 50 | Balance | 23.79 | 13.24 | 0.92 | 0.40 | 2.22 |
| 06 | 45.5 | 45.5 | 5.0 | 2.5 | 1.5 | 50 | Balance | 23.66 | 13.19 | 0.91 | 0.50 | 2.21 |
| 58 | 45.3 | 45.3 | 5.0 | 3.0 | 1.5 | 50 | Balance | 23.53 | 13.15 | 0.91 | 0.60 | 2.21 |
| 59 | 44.3 | 44.3 | 5.0 | 5.0 | 1.5 | 50 | Balance | 23.01 | 12.97 | 0.89 | 1.00 | 2.19 |
| 60 | 43.8 | 43.8 | 5.0 | 6.0 | 1.5 | 50 | Balance | 22.75 | 12.88 | 0.88 | 1.20 | 2.18 |

TABLE 8

| Sintered | Average particle Diameter of carbide [μm] | | Area ratio of phase | Maximum diameter of phase | Thermal expansion coefficient, | Average abrasion depth, | Increase in weight due to oxidization, $g/m^2$ | | | |
|---|---|---|---|---|---|---|---|---|---|---|
| sample | PhaseA | PhaseB | A, % | A, μm | $10^{-6}K^{-1}$ | μm | 850° C. | 900° C. | 950° C. | Note |
| 42 | 20 | 4 | 50 | 250 | 15.6 | 2.0 | 6 | 9 | 14 | Additive amount of Nickel powders less than lower limited value. |
| 43 | 18 | 4 | 50 | 240 | 16.0 | 1.7 | 5 | 7 | 12 | Additive amount of Nickel powders equal to lower limited value. |
| 44 | 18 | 4 | 49 | 240 | 16.3 | 1.5 | 4 | 6 | 11 | |
| 06 | 17 | 4 | 49 | 240 | 16.5 | 1.2 | 4 | 7 | 11 | |
| 45 | 16 | 4 | 48 | 240 | 16.7 | 1.1 | 4 | 6 | 10 | |
| 46 | 15 | 4 | 48 | 230 | 16.8 | 1.0 | 4 | 6 | 10 | |
| 47 | 15 | 4 | 46 | 230 | 17.0 | 2.0 | 4 | 7 | 10 | Additive amount of Nickel powders equal to upper limited value. |
| 48 | 15 | 4 | 36 | 220 | 17.1 | 4.0 | 4 | 6 | 10 | Additive amount of Nickel powders more than upper limited value. |
| 49 | 6 | 1 | 44 | 180 | 15.8 | 6.2 | 7 | 15 | 22 | Additive amount of graphite powders less than lower limited value. |
| 50 | 10 | 3 | 46 | 200 | 16.2 | 1.9 | 5 | 8 | 13 | Additive amount of graphite powders equal to lower limited value. |

TABLE 8-continued

| Sintered sample | Average particle Diameter of carbide [μm] PhaseA | PhaseB | Area ratio of phase A, % | Maximum diameter of phase A, μm | Thermal expansion coefficient, $10^{-6}K^{-1}$ | Average abrasion depth, μm | Increase in weight due to oxidization, $g/m^2$ 850° C. | 900° C. | 950° C. | Note |
|---|---|---|---|---|---|---|---|---|---|---|
| 51 | 15 | 4 | 48 | 220 | 16.5 | 1.6 | 4 | 6 | 10 | |
| 06 | 17 | 4 | 49 | 240 | 16.5 | 1.2 | 4 | 7 | 11 | |
| 52 | 25 | 6 | 52 | 280 | 16.5 | 1.1 | 5 | 8 | 12 | |
| 53 | 50 | 10 | 56 | 360 | 16.6 | 0.8 | 10 | 13 | 18 | Additive amount of graphite powders equal to upper limited value. |
| 54 | — | — | — | — | — | — | — | — | — | Additive amount of graphite powders equal to upper limited value, losing shape. |
| 55 | 8 | 2 | 52 | 160 | 16.5 | 4.0 | 16 | 22 | 32 | Additive amount of iron-phosphorus alloy powders less than lower limited value. |
| 56 | 10 | 3 | 51 | 200 | 16.5 | 2.0 | 6 | 8 | 14 | Additive amount of iron-phosphorus alloy powders equal to lower limited value. |
| 57 | 14 | 3 | 49 | 230 | 16.5 | 1.5 | 5 | 7 | 12 | |
| 06 | 17 | 4 | 49 | 240 | 16.5 | 1.2 | 4 | 7 | 11 | |
| 58 | 24 | 4 | 49 | 260 | 16.5 | 1.2 | 3 | 7 | 11 | |
| 59 | 46 | 10 | 52 | 300 | 16.5 | 1.8 | 6 | 9 | 13 | Additive amount of iron-phosphorus alloy powders equal to upper limited value. |
| 60 | — | — | — | — | — | — | — | — | — | Additive amount of iron-phosphorus alloy powders more than upper limited value, losing shape. |

Referring to the sintered samples 06 and 42 to 48 shown in Tables 7 and 8, the influences of the additive amounts of the nickel powder can be recognized. In the sintered sample 42 not made of the nickel powder, the corresponding compact cannot be promoted in densification during the corresponding sintering process so that the density of the thus sintered sample is decreased (density ratio: 85%). The increase in weight of the sintered sample due to the oxidization is therefore relatively developed. Moreover, the strength of the sintered sample is decreased while the abrasion depth of the sintered sample is increased due to the low sintered density. In the sintered sample 42, the thermal expansion coefficient is decreased up to less than $16\times10^{-6}K^{-1}$ because the sintered sample is insufficiently austenitized due to the shortage of nickel in the sintered sample.

In the sintered sample 43 made of 1 mass % of the nickel powder, the densification of the sintered sample is promoted (density ratio: 90%) due to the addition of the nickel powder, thereby reducing the increase in weight of the sintered sample due to oxidization and thus decreasing the abrasion depth of the sintered sample. Moreover, the content of nickel contained in the sintered sample is increased so as to increase the thermal expansion coefficient up to $16\times10^{-6}K^{-1}$. In the sintered samples 06 and 44 to 48 made of the respective larger amounts of the nickel powder, the thermal expansion coefficients thereof are likely to be increased as the additive amount of the nickel powder is increased. The increases in weight of the sintered samples due to oxidization are reduced by the addition of the nickel powder, but the reduction effects for the increases in weight thereof are no longer developed within an additive amount of 3 mass % or more of the nickel powder.

If the nickel powder is excessively added, however, the nickel elements not diffused during sintering remain as some nickel phase. The remaining nickel phase correspond to metallic structures having respective low strengths and wear resistances, and if the distribution amount of the remaining nickel phase is increased, the wear resistance of the corresponding sintered sample is decreased. In this point of view, if the additive amount of the nickel powder falls within a range of 10 mass % or less, the densification of the sintered sample is promoted by the addition of the nickel powder so as to decrease the abrasion depth thereof, but if the additive amount of the nickel powder falls within a range of more than 10 mass %, the decrease in wear resistance of the sintered sample is promoted by the distribution of the remaining nickel phase so as to increase the abrasion depth thereof. In the sintered sample 47 made of the 12 mass % of the nickel powder, the abrasion depth thereof is increased up to 2 and if the additive amount of the nickel powder is set to more than 12 mass %, the abrasion depth of the corresponding sintered sample is increased up to more than 2 μm.

In this manner, it is confirmed that the addition of the nickel powder is required for the densification of the corresponding sintered sample and the additive amount of the nickel powder should be set within a range of 1 to 12 mass %.

Referring to the sintered samples 06 and 49 to 54 shown in Tables 7 and 8, the influences of the additive amounts of the graphite powder can be recognized. In the sintered sample 49 not made of the graphite powder, the carbides are formed originated from the carbon solid-solved in the iron alloy powder A so that the particle sizes of the chromium carbides formed in the phase A become small up to 6 μm. Moreover, Fe—P—C liquid phase are not generated while only Fe—P liquid phase is generated, resulting in the deterioration of densification at sintering and the decrease in sintered density of the sintered sample (density ratio: 85%). Therefore, the wear resistance of the sintered sample is remarkably decreased so that the abrasion depth thereof is increased up to 6.2 μm. Moreover, the decrease in sintered density of the sintered sample causes the increase in weight thereof due to oxidization. Furthermore, the precipitation amount of carbide is decreased so that the thermal expansion coefficient is decreased up to less than $16\times10^{-6}K^{-1}$ due to the increase of the amount of chromium to be solid-solved in the base material.

On the other hand, in the sample 50 made of 0.5 mass % of the graphite powder, the particle sizes of the chromium carbides to be formed in the phase A are increased up to 10 μm. Moreover, the Fe—C—P liquid phase is sufficiently generated so as to sufficiently densify the sintered sample and thus increase the sintered density of the sintered sample (density ratio: 89%). In this point of view, the abrasion depth of the sintered sample is decreased up to less than 2 μm. Furthermore, the increase in weight of the sintered sample due to oxidization is reduced by the sufficient densification of the sintered sample. In addition, the thermal expansion coefficient of the sintered sample is increased up to $16\times10^{-6}K^{-1}$ by the decrease of the amount of chromium which is precipitated as carbides and solid solved in the base material.

The particle sizes of the chromium carbides precipitated in the phase A and the phase B are increased within a range of 2.5 mass or less as the additive amount of the graphite powder is increased, and in the sintered sample 53 made of 2.5 mass % of the graphite powder, the particle sizes of the chromium carbides precipitated in the phase A are increased up to 50 μm and the particle sizes of the chromium carbides precipitated in the phase B are increased up to 10 p.m. The abrasion depths of the sintered samples are likely to be decreased by the addition of the graphite powder due to the promotion of densification in the sintered samples originated from the increases in particle size of the chromium carbides and the increases in generation of the Fe—P—C liquid phase.

If the particle sizes of the chromium carbides precipitated in the phase A and the phase B are larger than the respective prescribed values, the amount of the chromium to be solid-solved in the base material is decreased. Therefore, the promotion of densification of the sintered sample becomes dominant within a range of 1.5 mass % or less of the graphite powder so that the increase in weight of the sintered sample due to oxidization is reduced, but the oxidation resistance of the sintered sample is decreased within a range of more than 1.5 mass % of the graphite powder due to the decrease of the amount of the chromium to be solid-solved in the base material so that the increase in weight of the sintered sample due to oxidization is developed.

In the sintered sample 54 made of more than 2.5 mass % of the graphite powder, the Fe—P—C liquid phase is excessively generated so as to cause the losing shape of the sintered sample.

In this manner, it is confirmed that the addition of the graphite powder is required for the precipitations of the chromium carbides at the respective desirable particle sizes and the additive amount of the graphite powder should be set within a range of 0.5 to 2.5 mass % so as to promote the densification of the sintered sample during sintering and enhance the wear resistance thereof.

Referring to the sintered samples 06 and 55 to 60 shown in Tables 7 and 8, the influences of the additive amounts of the iron-phosphorus powder can be recognized. In the sintered sample 55 not made of the iron-phosphorus powder, Fe—P—C liquid phase is not generated, resulting in the deterioration of densification at sintering and the decrease in sintered density of the sintered sample (density ratio: 82%). Therefore, the increase in weight of the sintered sample due to oxidization is developed. Moreover, since the Fe—P—C liquid phase is not generated so that the sintering is not actively conducted, the particle sizes of the chromium carbides precipitated in the phase A is decreased up to less than 10 μm so that the abrasion depth of the sintered sample is increased by the decreases in particle size of the chromium carbides to be precipitated in the phase A and the decrease of strength of the sintered sample due to the decrease of the sintered density.

On the other hand, in the sample 56 made of 1 mass % of the iron-phosphorus powder, the Fe—C—P liquid phase is sufficiently generated so as to sufficiently densify the sintered sample and thus increase the sintered density of the sintered sample (density ratio: 88%). In this point of view, the increase in weight of the sintered sample due to oxidization is reduced by the sufficient densification of the sintered sample. Moreover, since the Fe—P—C liquid phase is sufficiently generated so that the sintering is actively conducted, the particle sizes of the chromium carbides precipitated in the phase A are increased up to 10 μm so that the abrasion depth of the sintered sample is decreased by the increase of strength of the sintered sample due to the increase of the sintered density.

In the case that the additive amount of the iron-phosphorus powder is much increased, the amount of the Fe—C—P liquid phase is increased and the sintering is actively conducted as the additive amount of the iron-phosphorus powder is increased, thereby growing the chromium carbides precipitated in the phase A and the phase B remarkably.

However, the promotion of densification of the sintered sample becomes dominant within an additive amount range of 3 mass % or less of the iron-phosphorus powder so as to increase the sintered density thereof (density ratio: 95%) by the generations of the Fe—C—P liquid phase, but does not become dominant within an additive amount range of more than 3 mass % of the iron-phosphorus powder so as to decrease the sintered density by the temporally excess generations of the Fe—C—P liquid phase causing the enlargement of the space between the adjacent powder and the prevention of densification due to liquid phase contraction. As a result, the abrasion depth and increase in weight of the sintered sample due to oxidization are likely to be decreased within an additive amount range of 3 mass % or less of the iron-phosphorus powder, but increased within an additive amount range of more than 3 mass % of the iron-phosphorus powder subject to the decrease of the sintered density.

In the sintered sample 60 made of more than 5 mass % of the iron-phosphorus powder, the Fe—P—C liquid phase is excessively generated so as to cause the losing shape of the sintered sample.

In this manner, it is confirmed that the addition of the iron-phosphorus powder is required for the promotion of densification of the sintered sample during sintering causing the enhancement the wear resistance thereof and the additive amount of the iron-phosphorus powder should be set within a range of 1 to 5 mass %.

Example 5

The raw material powder was prepared in the same manner as the sintered sample 06 in Example 1 with respect to the mixing ratio of the iron alloy powder A and the like and the composition, compressed in the same manner as in Example 1 and sintered at the respective sintering temperature shown in Table 9 instead of the sintering temperature in Example 1 to form the sintered samples 61 to 66 in the shape of pillar and in the shape of thin plate. With respect to the sintered samples, the average particle diameters of carbides in the phase A and the phase B, the ratio of the phase A, the maximum dimension of the phase A, the thermal expansion coefficients, the increases in weight after oxidizing test and the abrasion depths after roll-on-disc abrasion test were measured in the same manner as in Example 1. The results were listed in Table 9. In Table 9, the results of the sintered sample 06 obtained in Example 1 were listed together.

TABLE 9

| Sintered sample | Sintering temperature ° C. | Average particle Diameter of carbide [μm] PhaseA | PhaseB | Area ratio of phase A, % | Maximum diameter of phase A, μm | Thermal expansion coefficient, $10^{-6}K^{-1}$ | Average abrasion depth, μm | Increase in weight due to oxidization, $g/m^2$ 850° C. | 900° C. | 950° C. | Note |
|---|---|---|---|---|---|---|---|---|---|---|---|
| 61 | 950 | 7 | 2 | 47 | 200 | 16.5 | 2.6 | 15 | 19 | 38 | Sintering temperature less than lower limited value. |
| 62 | 1000 | 11 | 3 | 47 | 210 | 16.5 | 1.6 | 8 | 12 | 19 | Sintering temperature equal to lower limited value. |
| 63 | 1050 | 13 | 3 | 48 | 230 | 16.4 | 1.4 | 5 | 9 | 15 | |
| 06 | 1100 | 17 | 4 | 49 | 240 | 16.5 | 1.2 | 4 | 7 | 11 | |
| 64 | 1150 | 21 | 6 | 46 | 260 | 16.5 | 1.3 | 4 | 7 | 11 | |
| 65 | 1200 | 22 | 10 | 20 | 300 | 16.4 | 1.9 | 4 | 7 | 11 | Sintering temperature equal to upper limited value. |
| 66 | 1250 | 25 | 18 | 10 | 360 | 16.5 | 2.3 | 4 | 7 | 12 | Sintering temperature more than upper limited value. |

Referring to the sintered samples 06 and 61 to 66 shown in Table 9, the influences of the sintering temperatures can be recognized. In the sintered sample 61 sintered at a sintering temperature of 950° C., since the sintering temperature is smaller than the temperature where Fe—P liquid phase is generated, Fe—P—C liquid phase is not generated, resulting in the deterioration of the densification of the sintered sample and thus the decrease in density of the sintered sample (density ratio: 82%). The increase in weight of the sintered sample due to oxidization is therefore relatively developed. Moreover, the sintering is not actively conducted because the Fe—P—C liquid phase is not generated so that the particle sizes of the chromium carbides precipitated in the phase A are decreased up to less than 10 μm, so that the abrasion depth of the sintered sample is increased due to the decreases of the particle sizes of the chromium carbides and the decrease of the wear resistance thereof by the decrease of the strength thereof originated from the decrease of the sintered density thereof.

On the other hand, in the sintered sample 57 sintered at a sintering temperature of 1000° C., the Fe—P—C liquid phase is sufficiently generated, allowing the enhancement of the densification of the sintered sample and thus the increase in density of the sintered sample (density ratio: 87%). The increase in weight of the sintered sample due to oxidization is therefore reduced. Moreover, the sintering is actively conducted because the Fe—P—C liquid phase is sufficiently generated so that the particle sizes of the chromium carbides precipitated in the phase A are increased up to more than 10 μm. Therefore, the abrasion depth of the sintered sample is decreased due to the increases of the particle sizes of the chromium carbides beyond 10 μm and the increase of the strength thereof originated from the increase of the sintered density thereof.

If the sintering temperature is much increased, the sintering is actively conducted so as to promote the densification of the sintered sample and thus the decrease in weight of the sintered sample due to oxidization as the sintering temperature is increased. However, the difference in concentration between the phase A and the phase B becomes small due to the diffusions of the respective elements contained in the phase A and phase B with the increase of the activity of the sintering so that the chromium carbides contained in the phase B grow remarkably as compared with the chromium carbides contained in the phase A. The growth of the chromium carbides in the phase B prevents the plastic flow of the base material so as to contribute to the decrease of the abrasion depth of the sintered sample to some degrees. However, the too growth of the chromium carbides increases the attack on the opponent component (rolling member) so that the abrasion powder of the opponent component serve as abrading agents. Moreover, the too growth of the chromium carbides decreases the precipitation area of the carbides so that the spaces between the adjacent carbides are enlarged so as to increase the number of origin of metallic adhesion. As a result, the abrasion of the sintered sample is increased.

In this manner, it is confirmed that the sintered temperature is set within a range of 1000 to 1200° C.

Example 6

The iron allay powders A and the iron alloy powders B having the respective compositions shown in Table 10 were prepared, and mixed with the iron-phosphorus alloy powder, the nickel powder and the graphite powder which were used in Example 1 at the ratios shown in Table 10 to blend the respective raw material powder. The thus obtained raw material powder was compressed and sintered in the same manner as in Example 1 to form sintered samples 67 to 92 in the shape of pillar and in the shape of thin plate. The compositions of the sintered samples were listed in Table 11. With respect to the sintered samples, the average particle diameters of carbides in the phase A and the phase B, the ratio of the phase A, the maximum dimension of the phase A, the thermal expansion coefficients, the increases in weight after oxidizing test and the abrasion depths after roll-on-disc abrasion test were measured in the same manner as in Example 1. The results were listed in Table 11. In Tables 10 and 11, the composition and measured results of the sintered sample 06 obtained in Example 1 were listed together.

TABLE 10

| Sintered sample | Mixing ratio, mass % | | | | | | | | | | | | | | | | | |
|---|---|---|---|---|---|---|---|---|---|---|---|---|---|---|---|---|---|---|
| | Iron alloy powders A | | | | | | | | Iron alloy powders B | | | | | | Nickel powders | Iron-phosphorus alloy powders | Graphite powders | A/B % |
| | | Composition, mass % | | | | | | | | Composition, mass % | | | | | | | | |
| | | Fe | Cr | Ni | Si | C | Mo | V | | Fe | Cr | Ni | Mo | V | | | | |
| 06 | 45.5 | Balance | 34.0 | 10.0 | 2.0 | 2.0 | — | — | 45.5 | Balance | 18.0 | 8.0 | — | — | 5.0 | 2.5 | 1.5 | 50 |
| 67 | 45.5 | Balance | 34.0 | 10.0 | 2.0 | 2.0 | 2.2 | — | 45.5 | Balance | 18.0 | 8.0 | — | — | 5.0 | 2.5 | 1.5 | 50 |
| 68 | 45.5 | Balance | 34.0 | 10.0 | 2.0 | 2.0 | 4.4 | — | 45.5 | Balance | 18.0 | 8.0 | — | — | 6.0 | 2.5 | 1.5 | 50 |
| 69 | 45.5 | Balance | 34.0 | 10.0 | 2.0 | 2.0 | 6.6 | — | 45.5 | Balance | 18.0 | 8.0 | — | — | 5.0 | 2.5 | 1.5 | 50 |
| 70 | 45.5 | Balance | 34.0 | 10.0 | 2.0 | 2.0 | 11.0 | — | 45.5 | Balance | 18.0 | 8.0 | — | — | 5.0 | 2.5 | 1.5 | 50 |
| 71 | 45.5 | Balance | 34.0 | 10.0 | 2.0 | 2.0 | 15.4 | — | 45.5 | Balance | 18.0 | 8.0 | — | — | 6.0 | 2.5 | 1.5 | 50 |
| 06 | 45.5 | Balance | 34.0 | 10.0 | 2.0 | 2.0 | — | — | 45.5 | Balance | 18.0 | 8.0 | — | — | 5.0 | 2.5 | 1.5 | 50 |
| 72 | 45.5 | Balance | 34.0 | 10.0 | 2.0 | 2.0 | — | — | 45.5 | Balance | 18.0 | 8.0 | 2.2 | — | 5.0 | 2.5 | 1.5 | 50 |
| 73 | 45.5 | Balance | 34.0 | 10.0 | 2.0 | 2.0 | — | — | 45.5 | Balance | 18.0 | 8.0 | 4.4 | — | 5.0 | 2.5 | 1.5 | 50 |
| 74 | 45.5 | Balance | 34.0 | 10.0 | 2.0 | 2.0 | — | — | 45.5 | Balance | 18.0 | 8.0 | 6.6 | — | 5.0 | 2.5 | 1.5 | 50 |
| 75 | 45.5 | Balance | 34.0 | 10.0 | 2.0 | 2.0 | — | — | 45.5 | Balance | 18.0 | 8.0 | 11.0 | — | 5.0 | 2.5 | 1.5 | 50 |
| 76 | 45.5 | Balance | 34.0 | 10.0 | 2.0 | 2.0 | — | — | 45.5 | Balance | 18.0 | 8.0 | 15.4 | — | 5.0 | 2.5 | 1.5 | 50 |
| 06 | 45.5 | Balance | 34.0 | 10.0 | 2.0 | 2.0 | — | — | 45.5 | Balance | 18.0 | 8.0 | — | — | 5.0 | 2.5 | 1.5 | 50 |
| 77 | 45.5 | Balance | 34.0 | 10.0 | 2.0 | 2.0 | 4.4 | — | 45.5 | Balance | 18.0 | 8.0 | 2.2 | — | 5.0 | 2.5 | 1.5 | 50 |
| 78 | 45.5 | Balance | 34.0 | 10.0 | 2.0 | 2.0 | 4.4 | — | 45.5 | Balance | 18.0 | 8.0 | 6.6 | — | 5.0 | 2.5 | 1.5 | 50 |
| 79 | 45.5 | Balance | 34.0 | 10.0 | 2.0 | 2.0 | 4.4 | — | 45.5 | Balance | 18.0 | 8.0 | 11.0 | — | 5.0 | 2.5 | 1.5 | 50 |
| 06 | 45.5 | Balance | 34.0 | 10.0 | 2.0 | 2.0 | — | — | 45.5 | Balance | 18.0 | 8.0 | — | — | 5.0 | 2.5 | 1.5 | 50 |
| 80 | 45.5 | Balance | 34.0 | 10.0 | 2.0 | 2.0 | — | 2.2 | 45.5 | Balance | 18.0 | 8.0 | — | — | 5.0 | 2.5 | 1.5 | 50 |
| 81 | 45.5 | Balance | 34.0 | 10.0 | 2.0 | 2.0 | — | 4.4 | 45.5 | Balance | 18.0 | 8.0 | — | — | 5.0 | 2.5 | 1.5 | 50 |
| 82 | 45.5 | Balance | 34.0 | 10.0 | 2.0 | 2.0 | — | 6.6 | 45.5 | Balance | 18.0 | 8.0 | — | — | 5.0 | 2.5 | 1.5 | 50 |
| 83 | 45.5 | Balance | 34.0 | 10.0 | 2.0 | 2.0 | — | 11.0 | 45.5 | Balance | 18.0 | 8.0 | — | — | 5.0 | 2.5 | 1.5 | 50 |
| 84 | 45.5 | Balance | 34.0 | 10.0 | 2.0 | 2.0 | — | 15.4 | 45.5 | Balance | 18.0 | 8.0 | — | — | 5.0 | 2.5 | 1.5 | 50 |
| 06 | 45.5 | Balance | 34.0 | 10.0 | 2.0 | 2.0 | — | — | 45.5 | Balance | 18.0 | 8.0 | — | — | 5.0 | 2.5 | 1.5 | 50 |
| 85 | 45.5 | Balance | 34.0 | 10.0 | 2.0 | 2.0 | — | — | 45.5 | Balance | 18.0 | 8.0 | — | 2.2 | 5.0 | 2.5 | 1.5 | 50 |
| 86 | 45.5 | Balance | 34.0 | 10.0 | 2.0 | 2.0 | — | — | 45.5 | Balance | 18.0 | 8.0 | — | 4.4 | 5.0 | 2.5 | 1.5 | 50 |
| 87 | 45.5 | Balance | 34.0 | 10.0 | 2.0 | 2.0 | — | — | 45.5 | Balance | 18.0 | 8.0 | — | 6.6 | 5.0 | 2.5 | 1.5 | 50 |
| 88 | 45.5 | Balance | 34.0 | 10.0 | 2.0 | 2.0 | — | — | 45.5 | Balance | 18.0 | 8.0 | — | 11.0 | 5.0 | 2.5 | 1.5 | 50 |
| 89 | 45.5 | Balance | 34.0 | 10.0 | 2.0 | 2.0 | — | — | 45.5 | Balance | 18.0 | 8.0 | — | 15.4 | 5.0 | 2.5 | 1.5 | 50 |
| 81 | 45.5 | Balance | 34.0 | 10.0 | 2.0 | 2.0 | — | 4.4 | 45.5 | Balance | 18.0 | 8.0 | — | — | 5.0 | 2.5 | 1.5 | 50 |
| 90 | 45.5 | Balance | 34.0 | 10.0 | 2.0 | 2.0 | — | 4.4 | 45.5 | Balance | 18.0 | 8.0 | — | 2.2 | 5.0 | 2.5 | 1.5 | 50 |
| 91 | 45.5 | Balance | 34.0 | 10.0 | 2.0 | 2.0 | — | 4.4 | 45.5 | Balance | 18.0 | 8.0 | — | 6.6 | 5.0 | 2.5 | 1.5 | 50 |
| 92 | 45.5 | Balance | 34.0 | 10.0 | 2.0 | 2.0 | — | 4.4 | 45.5 | Balance | 18.0 | 8.0 | — | 11.0 | 5.0 | 2.5 | 1.5 | 50 |

TABLE 11

| Sinteed sample | Composition, mass % | | | | | | | | Average particle diameter of carbide [μm] | | Area ratio of phase | Maximum diameter of phase | Thermal expansion coefficient, | Average abrasion depth, | Increase in weight due to oxidization, | | | Note |
|---|---|---|---|---|---|---|---|---|---|---|---|---|---|---|---|---|---|---|
| | Fe | Cr | Ni | Si | P | C | Mo | V | Phase A | Phase B | A, % | A, μm | $10^{-6}K^{-1}$ | mm | 850° C. | 900° C. | 950° C. | |
| 06 | Bal. | 23.66 | 13.19 | 0.91 | 0.50 | 2.21 | — | — | 17 | 4 | 49 | 240 | 16.5 | 1.2 | 4 | 7 | 11 | |
| 67 | Bal. | 23.66 | 13.19 | 0.91 | 0.50 | 2.21 | 1.00 | — | 19 | 4 | 50 | 240 | 16.3 | 1.1 | 4 | 7 | 10 | |
| 68 | Bal. | 23.66 | 13.19 | 0.91 | 0.50 | 2.21 | 2.00 | — | 20 | 4 | 51 | 240 | 16.2 | 1.0 | 3 | 6 | 9 | |
| 69 | Bal. | 23.66 | 13.19 | 0.91 | 0.50 | 2.21 | 3.00 | — | 22 | 4 | 52 | 240 | 16.1 | 1.0 | 3 | 5 | 8 | |
| 70 | Bat | 23.66 | 13.19 | 0.91 | 0.50 | 2.21 | 5.00 | — | 25 | 4 | 53 | 240 | 16.0 | 1.0 | 3 | 5 | 8 | |
| 71 | Bal. | 23.66 | 13.19 | 0.91 | 0.50 | 2.21 | 7.00 | — | 30 | 4 | 54 | 240 | 15.6 | 1.0 | 3 | 5 | 8 | (*1) |
| 06 | Bal. | 23.66 | 13.19 | 0.91 | 0.50 | 2.21 | — | — | 17 | 4 | 49 | 240 | 16.5 | 1.2 | 4 | 7 | 11 | |
| 72 | Bal. | 23.66 | 13.19 | 0.91 | 0.50 | 2.21 | 1.00 | — | 17 | 5 | 50 | 240 | 16.4 | 1.1 | 3 | 7 | 11 | |
| 73 | Bal. | 23.66 | 13.19 | 0.91 | 0.50 | 2.21 | 2.00 | — | 17 | 7 | 50 | 240 | 16.3 | 1.1 | 3 | 6 | 9 | |
| 74 | Bal. | 23.66 | 13.19 | 0.91 | 0.50 | 2.21 | 3.00 | — | 17 | 8 | 50 | 230 | 16.2 | 1.0 | 3 | 5 | 9 | |
| 75 | Bal. | 23.66 | 13.19 | 0.91 | 0.50 | 2.21 | 5.00 | — | 17 | 8 | 50 | 220 | 16.1 | 1.0 | 3 | 5 | 9 | |
| 76 | Bal. | 23.66 | 13.19 | 0.91 | 0.50 | 2.21 | 7.00 | — | 17 | 8 | 50 | 220 | 15.5 | 1.0 | 3 | 5 | 9 | (*1) |
| 06 | Bal. | 23.66 | 13.19 | 0.91 | 0.50 | 2.21 | — | — | 17 | 4 | 49 | 240 | 16.5 | 1.2 | 4 | 7 | 11 | |
| 77 | Bal. | 23.66 | 13.19 | 0.91 | 0.50 | 2.21 | 3.00 | — | 20 | 6 | 52 | 240 | 16.1 | 0.8 | 2 | 4 | 6 | |
| 78 | Bal. | 23.66 | 13.19 | 0.91 | 0.50 | 2.21 | 5.00 | — | 21 | 8 | 49 | 220 | 16.0 | 0.8 | 2 | 4 | 6 | |
| 79 | Bal. | 23.66 | 13.19 | 0.91 | 0.50 | 2.21 | 7.00 | — | 22 | 9 | 48 | 200 | 15.4 | 0.8 | 2 | 4 | 6 | (*1) |
| 06 | Bal. | 23.66 | 13.19 | 0.91 | 0.50 | 2.21 | — | — | 17 | 4 | 49 | 240 | 16.5 | 1.2 | 4 | 7 | 11 | |
| 80 | Bal. | 23.66 | 13.19 | 0.91 | 0.50 | 2.21 | — | 1.00 | 16 | 4 | 50 | 240 | 16.4 | 1.1 | 3 | 6 | 10 | |
| 81 | Bal. | 23.66 | 13.19 | 0.91 | 0.50 | 2.21 | — | 2.00 | 15 | 4 | 50 | 230 | 16.2 | 1.1 | 3 | 6 | 10 | |
| 82 | Bat | 23.66 | 13.19 | 0.91 | 0.50 | 2.21 | — | 3.00 | 15 | 4 | 50 | 230 | 16.2 | 1.0 | 3 | 5 | 8 | |
| 83 | Bal. | 23.66 | 13.19 | 0.91 | 0.50 | 2.21 | — | 5.00 | 14 | 4 | 50 | 230 | 16.1 | 1.0 | 3 | 5 | 8 | |
| 84 | Bal. | 23.66 | 13.19 | 0.91 | 0.50 | 2.21 | — | 7.00 | 14 | 4 | 50 | 220 | 15.9 | 1.0 | 3 | 5 | 8 | (*2) |
| 06 | Bal. | 23.66 | 13.19 | 0.91 | 0.50 | 2.21 | — | — | 17 | 4 | 49 | 240 | 16.5 | 1.2 | 4 | 7 | 11 | |
| 85 | Bal. | 23.66 | 13.19 | 0.91 | 0.50 | 2.21 | — | 1.00 | 16 | 4 | 49 | 230 | 16.4 | 1.0 | 4 | 6 | 10 | |

TABLE 11-continued

| Sinteed sample | Composition, mass % Fe | Cr | Ni | Si | P | C | Mo | V | Average particle diameter of carbide [μm] Phase A | Phase B | Area ratio of phase A, % | Maximum diameter of phase A, μm | Thermal expansion coefficient, $10^{-6}K^{-1}$ | Average abrasion depth, mm | Increase in weight due to oxidization, 850° C. | 900° C. | 950° C. | Note |
|---|---|---|---|---|---|---|---|---|---|---|---|---|---|---|---|---|---|---|
| 86 | Bal. | 23.66 | 13.19 | 0.91 | 0.50 | 2.21 | — | 2.00 | 16 | 3 | 47 | 220 | 16.4 | 1.0 | 3 | 6 | 9 | |
| 87 | Bal. | 23.66 | 13.19 | 0.91 | 0.50 | 2.21 | — | 3.00 | 16 | 3 | 47 | 220 | 16.2 | 1.0 | 2 | 5 | 9 | |
| 88 | Bal. | 23.66 | 13.19 | 0.91 | 0.50 | 2.21 | — | 5.00 | 16 | 3 | 46 | 210 | 16.1 | 1.0 | 2 | 5 | 9 | |
| 89 | Bal. | 23.66 | 13.19 | 0.91 | 0.50 | 2.21 | — | 7.00 | 16 | 3 | 43 | 200 | 15.9 | 1.0 | 2 | 5 | 9 | (*2) |
| 81 | Bal. | 23.66 | 13.19 | 0.91 | 0.50 | 2.21 | — | 2.00 | 15 | 4 | 50 | 230 | 16.2 | 1.1 | 3 | 6 | 10 | |
| 90 | Bal. | 23.66 | 13.19 | 0.91 | 0.50 | 2.21 | — | 3.00 | 14 | 3 | 49 | 200 | 16.1 | 0.8 | 3 | 4 | 7 | |
| 91 | Bal. | 23.66 | 13.19 | 0.91 | 0.50 | 2.21 | — | 5.00 | 14 | 3 | 48 | 180 | 16.0 | 0.8 | 3 | 4 | 7 | |
| 92 | Bal. | 23.66 | 13.19 | 0.91 | 0.50 | 2.21 | — | 7.00 | 14 | 3 | 46 | 180 | 15.5 | 0.8 | 3 | 4 | 7 | (*2) |

(*1) Content of Mo more than upper limited value
(*2) Content of V more than upper limited value
Bal. = Balance Referring to the sintered samples 06 and 67 to 79 shown in Tables 10 and 11, the influences of molybdenum (Mo) as an additive element can be recognized. In the sintered sample 06 and 67 to 71, molybdenum is added to the iron alloy powder A, and in the sintered sample 06 and 72 to 76, molybdenum is added to the iron alloy powder B, and in the sintered sample 06 and 72 to 79, molybdenum is added to both of the iron alloy powder A and the iron alloy powder B.

The molybdenum has a high formability of carbide, and in any case where the molybdenum is added to the iron alloy powder A and the molybdenum is added to the iron alloy powder B, and the molybdenum is added to both of the iron alloy powder A and the iron alloy powder B, the wear resistance of the corresponding sintered sample is enhanced, and the abrasion depth of the corresponding sintered sample is decreased as the additive amount of the molybdenum is increased. In any case as described above, moreover, the increase in weight of the sintered sample due to oxidization is likely to be reduced as the additive amount of the molybdenum is increased.

In any case, however, the thermal expansion coefficient of the sintered sample is likely to be decreased as the additive amount of the molybdenum is increased, and in the sintered sample 71, 76 and 79 containing the additive amount of more than 5 mass %, the thermal expansion coefficient of the corresponding sintered sample is decreased up to less than $16\times10^{-6}K^{-1}$.

In this manner, it is confirmed that the additive amount of the molybdenum should be set within a range of 5 mass or less relative to the composition of the corresponding sintered sample because the addition of the molybdenum enhances the wear resistance and oxidation resistance of the corresponding sintered sample but if the additive amount of the molybdenum is more than 5 mass % relative to the composition of the corresponding sintered sample, the thermal expansion coefficient of the corresponding sintered sample is decreased up to less than $16\times10^{-6}K^{-1}$.

Referring to the sintered samples 06 and 80 to 92 shown in Tables 10 and 11, the influences of vanadium (V) as an additive element can be recognized. In the sintered sample 06 and 80 to 84, vanadium is added to the iron alloy powder A, and in the sintered sample 06 and 85 to 89, vanadium is added to the iron alloy powder B, and in the sintered sample 06 and 90 to 92, vanadium is added to both of the iron alloy powder A and the iron alloy powder B.

The vanadium has a high formability of carbide, and in any case where the vanadium is added to the iron alloy powder A and the vanadium is added to the iron alloy powder B, and the vanadium is added to both of the iron alloy powder A and the iron alloy powder B, the wear resistance of the corresponding sintered sample is enhanced, and the abrasion depth of the corresponding sintered sample is decreased as the additive amount of the vanadium is increased. In any case as described above, moreover, the increase in weight of the sintered sample due to oxidization is likely to be reduced as the additive amount of the vanadium is increased.

In any case, however, the thermal expansion coefficient of the sintered sample is likely to be decreased as the additive amount of the vanadium is increased, and in the sintered sample 84, 89 and 92 containing the additive amount of more than 5 mass %, the thermal expansion coefficient of the corresponding sintered sample is decreased up to less than $16\times10^{-6}K^{-1}$.

In this manner, it is confirmed that the additive amount of the vanadium should be set within a range of 5 mass % or less relative to the composition of the corresponding sintered sample because the addition of the vanadium enhances the wear resistance and oxidation resistance of the corresponding sintered sample but if the additive amount of the vanadium is more than 5 mass % relative to the composition of the corresponding sintered sample, the thermal expansion coefficient of the corresponding sintered sample is decreased up to less than $16\times10^{-6}K^{-1}$.

Although the present invention was described in detail with reference to the above examples, this invention is not limited to the above disclosure and every kind of variation and modification may be made without departing from the scope of the present invention.

INDUSTRIAL APPLICABILITY

The sintered alloy of the present invention exhibits such a metallic structure as the phase A containing precipitated metallic carbides within an average particle diameter of 5 to 50 μm are randomly dispersed in the phase B containing precipitated metallic carbides within an average particle diameter of 10 μm or less and excellent heat resistance, corrosion resistance and wear resistance at high temperature. Moreover, the sintered alloy has excellent machinability and thermal expansion coefficient similar to the one of an austenitic heat-resistant material because the sintered alloy has an austenitic base material. In this point of view, the sintered alloy is preferable for a turbo component for turbocharger and a nozzle body requiring heat resistance, corrosion resistance and wear resistance, etc.

What is claimed is:

1. A method for manufacturing a sintered alloy, comprising:

preparing an iron alloy powder A consisting of, in percentage by mass, Cr: 25 to 45, Ni: 5 to 15, Si: 1.0 to 3.0, C: 1.5 to 4.0 and the balance of Fe plus unavoidable impurities;

preparing an iron alloy powder B consisting of, in percentage by mass, Cr: 12 to 25, Ni: 5 to 15 and the balance of Fe plus unavoidable impurities;

preparing an iron-phosphorus powder consisting of, in percentage by mass, P:10 to 30 and the balance of Fe plus unavoidable impurities, a nickel powder and a graphite powder;

mixing the iron alloy powder A with the iron alloy powder B so that a ratio of the iron alloy powder A to a total of the iron alloy powder A and the iron alloy powder B is within a range of 20 to 80 mass %, and adding the iron-phosphorus powder within a range of 1.0 to 5.0 mass %, the nickel powder within a range of 1 to 12 mass % and the graphite powder within a range of 0.5 to 2.5 mass % to form a raw material powder;

pressing and sintering the raw material powder to obtain the sintered alloy.

2. The method as set forth in claim 1, wherein a maximum particle diameter of the iron alloy powder A is set within a range of 300 μm or less.

3. The method as set forth in claim 1, wherein a maximum particle diameter of the nickel powder is set within a range of 74 μm or less.

4. The method as set forth in claim 1, further comprising:

adding 5 mass % or less of at least one selected from the group consisting of Mo, V, W, Nb and Ti to either or both of the iron alloy powder A and the iron alloy powder B.

5. The method as set forth in claim 1, wherein a sintering temperature is set within a range of 1000 to 1200° C.

6. The method as set forth in claim 1, wherein the iron alloy powder A contains carbon within a range of 2.0 to 4.0 mass %.

7. The method as set forth in claim 1, wherein the chromium content of the iron alloy powder A is larger than the chromium content of the iron alloy powder B.

8. The method as set forth in claim 1, wherein the iron alloy powder A has carbides containing chromium.

* * * * *